US007661933B2

(12) United States Patent
Ohya et al.

(10) Patent No.: US 7,661,933 B2
(45) Date of Patent: Feb. 16, 2010

(54) ELECTROMAGNETIC VIBRATING TYPE DIAPHRAGM PUMP

(75) Inventors: Ikuo Ohya, Takatsuki (JP); Hirokazu Komuro, Takatsuki (JP)

(73) Assignee: Techno Takatsuki Co., Ltd., Osaka (JP)

( * ) Notice: Subject to any disclaimer, the term of this patent is extended or adjusted under 35 U.S.C. 154(b) by 855 days.

(21) Appl. No.: 10/510,575

(22) PCT Filed: Jan. 22, 2003

(86) PCT No.: PCT/JP03/00506

§ 371 (c)(1),
(2), (4) Date: Oct. 8, 2004

(87) PCT Pub. No.: WO03/085264

PCT Pub. Date: Oct. 16, 2003

(65) Prior Publication Data

US 2005/0254971 A1 Nov. 17, 2005

(30) Foreign Application Priority Data

Apr. 8, 2002 (JP) ..... 2002-105611

(51) Int. Cl.
*F04B 17/00* (2006.01)

(52) U.S. Cl. ..... 417/413.1; 92/49

(58) Field of Classification Search ..... 417/246, 417/341, 342, 343, 522, 524, 534, 535, 413.1, 417/254, 257, 265, 266, 267, 268, 418, 244, 417/248, 250, 251, 258; 310/14, 24; 92/48, 92/49, 50

See application file for complete search history.

(56) References Cited

U.S. PATENT DOCUMENTS 2,090,424 A * 8/1937 Pateras Pescara ..... 417/341
2,111,168 A * 3/1938 Chansor ..... 200/83 N
3,483,412 A * 12/1969 Bakker et al. ..... 310/103
3,765,802 A * 10/1973 Leitermann et al. ..... 417/395

(Continued)

FOREIGN PATENT DOCUMENTS

CN 1302960 A 7/2001

(Continued)

OTHER PUBLICATIONS

Chinese Office Action dated Jun. 1, 2007 in corresponding Chinese patent application; 11 pages.

*Primary Examiner*—Devon C Kramer
*Assistant Examiner*—Amene S Bayou
(74) *Attorney, Agent, or Firm*—Antonelli, Terry, Stout & Kraus LLP.

(57) ABSTRACT

An electromagnetic vibrational diaphragm pump comprising an electromagnet portion having an electromagnet arranged in a frame, a vibrator which is supported in the electromagnet portion and equipped with a magnet, diaphragms with a large diameter and diaphragms with a small diameter which are successively connected with both ends of the vibrator, and the pump casing portions of the diaphragms with a large diameter and diaphragms with a small diameter which are fixed on the both end portions of the electromagnet portion, wherein the left and right pump casing portions have pump chambers respectively corresponding to the diaphragms with a large diameter and diaphragms with a small diameter. Medium pressure (about 50 to 200 kPa) can be generated.

27 Claims, 38 Drawing Sheets

U.S. PATENT DOCUMENTS

| | | | | | |
|---|---|---|---|---|---|
| 4,334,833 | A | * | 6/1982 | Gozzi | 417/258 |
| 4,390,322 | A | * | 6/1983 | Budzich | 417/243 |
| 4,538,964 | A | * | 9/1985 | Brown | 417/267 |
| 4,761,118 | A | * | 8/1988 | Zanarini | 417/254 |
| 5,011,379 | A | * | 4/1991 | Hashimoto | 417/360 |
| 5,062,770 | A | * | 11/1991 | Story et al. | 417/46 |
| 5,222,878 | A | * | 6/1993 | Osada et al. | 417/417 |
| 5,279,504 | A | * | 1/1994 | Williams | 417/393 |
| 6,533,560 | B2 | | 3/2003 | Ohya et al. | |

FOREIGN PATENT DOCUMENTS

| | | |
|---|---|---|
| EP | 1 114 933 A2 | 7/2001 |
| JP | 55-37582 | 3/1980 |
| JP | 56-143578 | 10/1981 |
| JP | 62-116183 | 7/1987 |
| JP | 5-43268 | 10/1993 |
| JP | 6-3190 | 1/1994 |
| JP | 6-69370 | 9/1994 |
| JP | 2542799 | 4/1997 |
| JP | 2000-299971 | 10/2000 |
| JP | 2002-285968 | 10/2002 |
| JP | 2534596 | 6/2006 |

* cited by examiner (a) The vibrator moves to right direction (b) The vibrator moves to left direction

ELECTROMAGNETIC VIBRATING TYPE DIAPHRAGM PUMP

RELATED APPLICATION

This application is a U.S. national phase application under 35 U.S.C. §371 of International Application No. PCT/JP03/00506 filed Jan. 22, 2003, which claims priority of Japanese Patent Application No. 2002-105611 filed Apr. 8, 2002.

TECHNICAL FIELD

The present invention relates to an electromagnetic vibrational diaphragm pump. More specifically, the present invention relates to an electromagnetic vibrational diaphragm pump which is mainly utilized for suction and disposal of air to an air mat and an air bed for interior, oxygen supply in a water vessel for fish farming, a home sanitation vessel and the like, or the sampling of test gas in pollution observation or the like.

BACKGROUND ART

There has been conventionally a diaphragm pump which is, for example, shown in FIG. 44, as an electromagnetic vibrational diaphragm pump sucking and discharging fluid utilizing the vibration of a vibrator which was equipped with a magnet based on electromagnetic interaction between an electromagnet and said magnet.

The pump is composed of an electromagnet portion 151 having an electromagnet 151*c* consisting of an iron core 151*a* provided in a frame 150 and a winding coil portion 151*b*, a vibrator 153 equipped with a magnet 152 which is arranged at a gap portion of said electromagnet, diaphragms 154 connected with both ends of said vibrator 153, and pump casing portions 155 respectively fixed on both end portions of the above-mentioned electromagnet portion.

In such pump, air sucked from a suction inlet 156 by the left and right vibrations of the above-mentioned vibrator 153 was once stored in the suction tank portion 157 of the above-mentioned electromagnet portion 151, then once stored in a discharge tank portion 161 through the suction chamber 158 of the pump casing portions 155, a pump chamber (compression chamber) 159 and a discharge chamber 160, and then discharged from a discharge portion 162.

However, the structure of a conventional diaphragm pump can generate only a low pressure of less than 50 kPa, therefore there is a problem that it is difficult to generate medium pressure (about 50 to 200 kPa). To the contrary, although a piston type pump can generate medium pressure, there are problems that life time is shorter than a diaphragm pump because of the abrasion of a piston and efficiency is low.

Further, it is also desired to make a diaphragm pump in a small size.

DISCLOSURE OF INVENTION

Under the above-mentioned circumstances, an object of the present invention is to provide an electromagnetic vibrational diaphragm pump which can generate medium pressure (about 50 to 200 kPa) and can be small-sized.

The electromagnetic vibrational diaphragm pump of the present invention is characterized by comprising an electromagnet portion having an electromagnet arranged in a frame, a vibrator which is supported in said electromagnet portion and equipped with a magnet, diaphragms with a large diameter and diaphragms with a small diameter which are successively connected with both ends of said vibrator, and the pump casing portions of said diaphragms with a large diameter and diaphragms with a small diameter which are fixed on the both end portions of the above-mentioned electromagnet portion, wherein said left and right pump casing portions have pump chambers respectively corresponding to the diaphragms with a large diameter and diaphragms with a small diameter.

Further, the electromagnetic vibrational diaphragm pump of the present invention is preferably a diaphragm pump in which the above-mentioned pump casing portions consist of a pump casing portion for the diaphragm with a large diameter and a pump casing portion for the diaphragm with a small diameter, and the pump chamber of the pump casing portion for the diaphragm with a large diameter and the pump chamber of the pump casing portion for the diaphragm with a small diameter are adjacent and partitioned by the diaphragm with a small diameter.

Further, the electromagnetic vibrational diaphragm pump of the present invention is preferably a diaphragm pump in which by conducting low pressure air generated in the pump chamber of the left diaphragm with a large diameter to the pump chamber of the right diaphragm with a small diameter and conducting low pressure air generated in the pump chamber of the right diaphragm with a large diameter to the pump chamber of the left diaphragm with a small diameter, air is compressed at two steps of two circuits as air circuit so that medium pressure air is generated by pumping action.

Further, the electromagnetic vibrational diaphragm pump of the present invention is a diaphragm pump in which by connecting the pump chamber of the left and right diaphragms with a large diameter and connecting the pump chamber of the left and right diaphragms with a small diameter, air is compressed in four steps of one circuit as air circuit so that medium pressure air is generated by pumping action.

Further, the electromagnetic diaphragm pump of the present invention is preferably a diaphragm pump in which the above-mentioned frame is a resin molded article molded on the outer surface of the above-mentioned electromagnet, and the first tank portion for vent and the second tank portion for vent which are connected with the left and right pump chambers and linked with the suction portion and the discharge portion, and ring shape grooves to which the above-mentioned diaphragms with a large diameter are installed are simultaneously molded.

Further, the electromagnetic vibrational diaphragm pump of the present invention is preferably a diaphragm pump in which the space between the above-mentioned left and right pump chambers is connected with vent pipes.

Further, the electromagnetic vibrational diaphragm pump of the present invention is preferably a diaphragm pump in which the above-mentioned frame is a resin molded article molded on the outer surface of the above-mentioned electromagnet, the first tank portion for vent and the second tank portion for vent which are connected with the left and right pump chambers and linked with the suction portion and the discharge portion, and ring shape grooves to which the above-mentioned diaphragms with a large diameter are installed are simultaneously molded, the suction chamber and the first tank portion for vent and the discharge chamber and the second tank portion for vent which are connected with the pump chambers of pump casings for the above-mentioned left and right diaphragms with a large diameter are linked with passages which are formed on the frame and the pump casings for the diaphragms with a large diameter, and the discharge chamber and the first tank portion for vent and the suction chamber and the second tank portion for vent which are connected with the pump chambers of pump casings for the above-mentioned left and right diaphragms with a small diameter are linked with passages which are formed on the pump casings for the diaphragm with a large diameter and the diaphragm with a small diameter.

Further, the electromagnetic vibrational diaphragm pump of the present invention is preferably a diaphragm pump in which the above-mentioned first tank portion for vent is separated by a partition portion.

Further, the electromagnetic vibrational diaphragm pump of the present invention is preferably a diaphragm pump in which linking holes which are linked with hermetic space which is hermetically sealed by the above-mentioned electromagnet portion and the diaphragm with a large diameter are formed on the above-mentioned second tank portion for vent, and pressure which was generated in the above-mentioned diaphragm with a large diameter is applied as back pressure on said diaphragm with a large diameter.

Further, the electromagnetic vibrational diaphragm pump of the present invention is equipped with at least 2 of the pump portions of the diaphragm with a small diameter in the above-mentioned left and right pump casing portions, and is preferably multi-step compression.

Further, the electromagnetic vibrational diaphragm pump of the present invention is preferably a diaphragm pump in which the outer dimension of the pump casings for the diaphragm with a large diameter and that of the pump casings for the diaphragm with a small diameter are nearly the same.

Further, the electromagnetic vibrational diaphragm pump of the present invention is preferably a diaphragm pump in which the suction chamber and the discharge chamber which are formed on the above-mentioned pump casings for the diaphragm with a large diameter and the pump casings for the diaphragm with a small diameter are arranged at a side-face side to a lateral direction of the pump chamber.

Further, the electromagnetic vibrational diaphragm pump of the present invention is preferably a diaphragm pump in which the above-mentioned frame is a resin molded article molded on the outer surface of the above-mentioned electromagnet, the first tank portion for vent and the second tank portion for vent which are connected with the left and right pump chambers and linked with the suction portion and the discharge portion and ring shape grooves to which the above-mentioned diaphragms with a large diameter are installed are simultaneously molded, the suction chamber and the first tank portion for vent and the discharge chamber and the second tank portion for vent which are connected with the pump chambers of pump casings for the above-mentioned left and right diaphragms with a large diameter are linked with passages which are formed on the frame and the pump casings for the diaphragm with a large diameter, and the discharge chamber and the first tank portion for vent and the suction chamber and the second tank portion for vent which are linked with passages which are formed on the pump casings for the diaphragm with a large diameter and the diaphragm with a small diameter.

Further, the electromagnetic vibrational diaphragm pump of the present invention is preferably a diaphragm pump in which the surface shape of the above-mentioned magnet indicates a convex shape.

Further, the electromagnetic diaphragm pump of the present invention is preferably a diaphragm pump in which the shape of bottom portion of the pump chambers of the pump casings for the above-mentioned diaphragm with a large diameter and the pump casings for the diaphragm with a small diameter is a cone shape or a semispherical shape.

Further, the electromagnetic vibrational diaphragm pump of the present invention is preferably a diaphragm pump in which side plates which are arranged on the side face of the above-mentioned pump casings for the diaphragm with a small diameter have legs for installation.

Further, the electromagnetic vibrational diaphragm pump of the present invention is an electromagnetic diaphragm pump comprising an electromagnet portion having an electromagnet arranged in a frame, a vibrator which is supported in said electromagnet portion and equipped with magnets, diaphragms which are connected with both ends of said vibrator, and the pump casings which are fixed on the both end portions of the above-mentioned electromagnet portion, wherein the suction chambers and the discharge chambers which are formed on said pump casings are arranged on the side-face side to a lateral direction of the pump chamber.

Further, the electromagnetic vibrational diaphragm pump of the present invention is preferably a diaphragm pump in which the diaphragms which are linked with the both end portions of the above-mentioned vibrator are the diaphragm with a large diameter and the diaphragm with a small diameter.

Further, the electromagnetic vibrational diaphragm pump of the present invention is preferably a diaphragm pump in which the above-mentioned frame is a resin molded article molded on the outer surface of the above-mentioned electromagnet, the first tank portion for vent and the second tank portion for vent which are connected with the left and right pump chambers and linked with the suction portion and the discharge portion, and ring shape grooves to which the above-mentioned diaphragms are installed are simultaneously molded, and the suction chamber and the first tank portion for vent and the discharge chamber and the second tank portion for vent which are connected with the pump chambers of the above-mentioned left and right pump casings are linked with passages which are formed by the frame and the pump casings.

Further, the electromagnetic vibrational diaphragm pump of the present invention is preferably a diaphragm pump in which the surface shape of the above-mentioned magnets indicates a convex shape.

Further, the electromagnetic vibrational diaphragm pump of the present invention is preferably a diaphragm pump in which the shape of bottom portion of the above-mentioned pump chambers of the pump casings for the diaphragm with a large diameter and the pump casings for the diaphragm with a small diameter is a cone shape or a semispherical shape.

Further, the electromagnetic vibrational diaphragm pump of the present invention is preferably a diaphragm pump in which side plates which are arranged on the side face of the above-mentioned pump casings for the diaphragm with a small diameter have legs for installation.

Further, the electromagnetic vibrational diaphragm pump of the present invention is preferably a diaphragm pump in which the above-mentioned electromagnetic consists of a pair of iron cores and winding coil portions which are assembled in the inner peripheral concave portion of said iron core.

Further, the electromagnetic vibrational diaphragm pump of the present invention is preferably a diaphragm pump in which the above-mentioned electromagnetic consists of a pair of iron cores with a small diameter, a pair of iron cores with a large diameter which are arranged at a position orthogonal to said pair of iron cores with a small diameter, and winding coil portions which are assembled in the inner peripheral concave portion of said iron cores with a large diameter.

Further, the electromagnetic vibrational diaphragm pump of the present invention is preferably a diaphragm pump in which the number of magnets of the above-mentioned vibrator is 4, the width dimension of 2 magnets at both end portions is about one half of the width dimension of 2 magnets at a central portion, the above-mentioned iron cores are an E shape, and the pole width dimensions of the center pole portion and the 2 side pole portions which face the above-mentioned magnets are nearly the same dimension together.

Further, the electromagnetic diaphragm pump of the present invention is preferably a diaphragm pump in which the above-mentioned diaphragms with a small diameter are a corrugation type diaphragm.

BRIEF DESCRIPTION OF DRAWINGS

FIG. 30(*b*) is a cross-eyed view of the packing and side board of FIG. 28.

FIG. 38(*b*) is a schema illustrating airflow viewed from the second tank portion for vent of FIG. 28.

BEST MODE FOR CARRYING OUT THE INVENTION

The electromagnetic vibrational diaphragm pump of the present invention is illustrated below based on the attached drawings.

Embodiment 1

Figure 1:
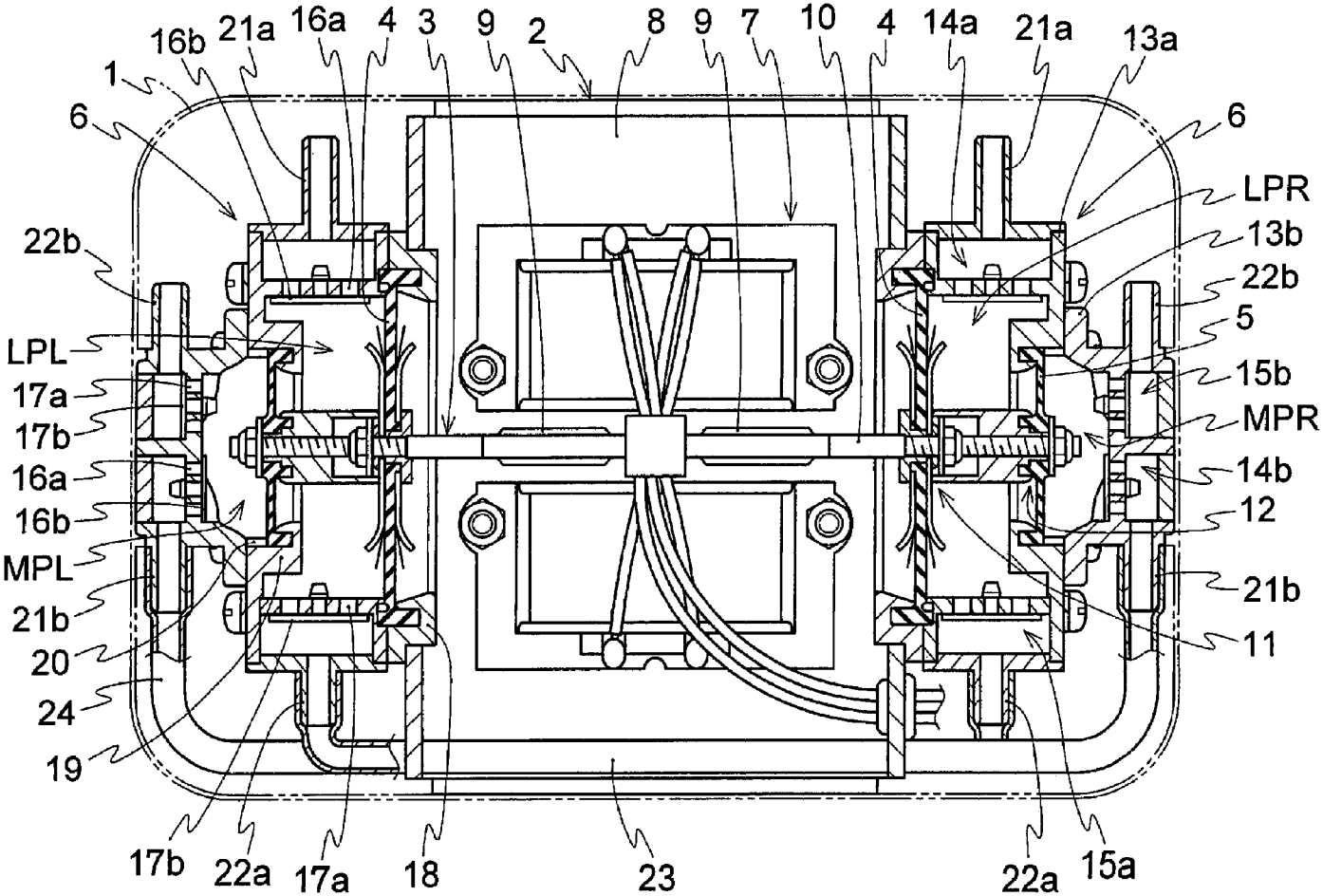
FIG. 1 is a partially notched horizontal sectional view showing the electromagnetic vibrational diaphragm pump related to Embodiment 1 of the present invention.
Figure 2:
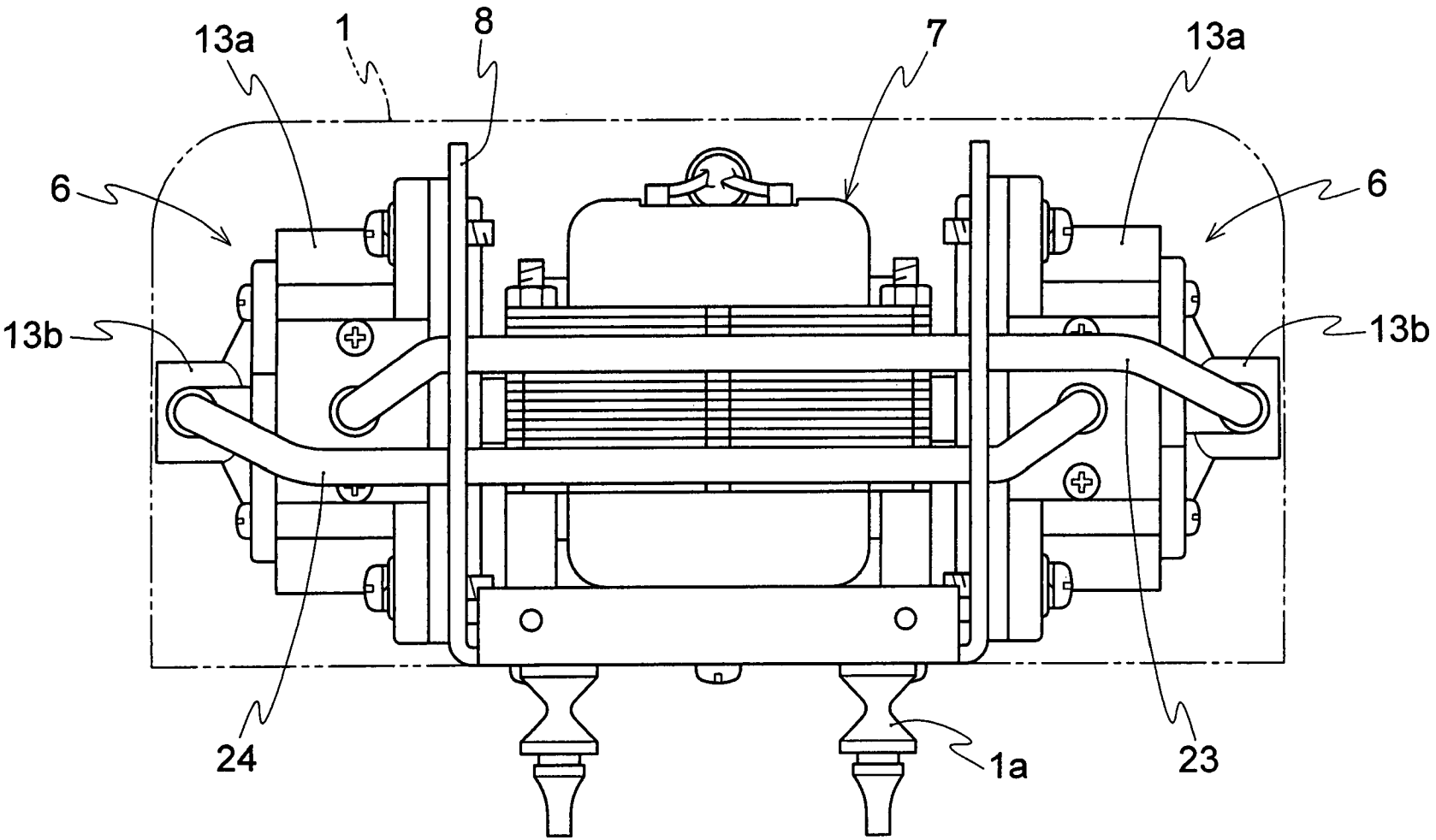
FIG. 2 is a back view of the pump of FIG. 1.
Figure 3:
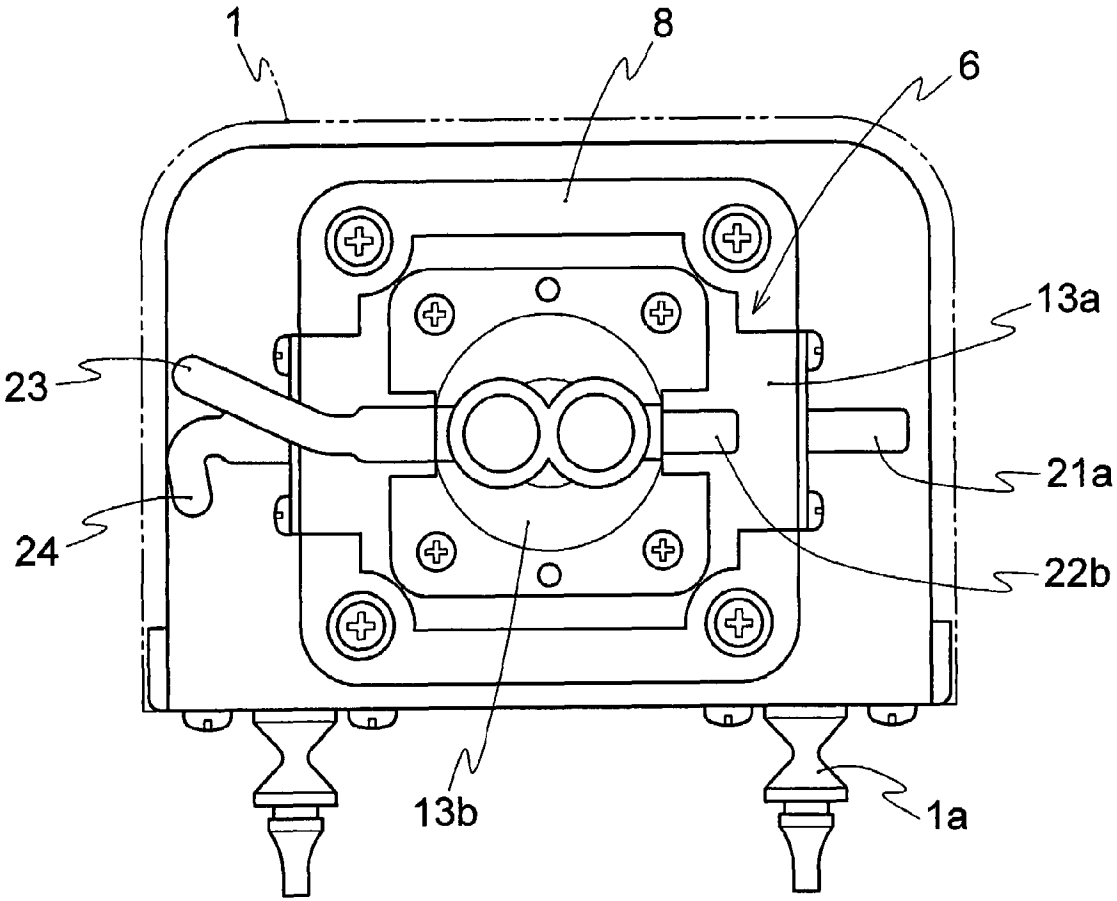
FIG. 3 is a right side view of the pump of FIG. 1.

As shown in FIGS. 1 to 3, the electromagnetic vibrational diaphragm pump related to Embodiment 1 of the present invention is composed of a pump body cover 1, an electromagnet portion 2, a vibrator portion 3, disc shape diaphragms with a large diameter 4 and diaphragms with a small diameter 5 which are successively connected with both ends of said vibrator 3, and the pump casing portions 6 of said diaphragms with a large diameter 4 and diaphragms with a small diameter 5 which are fixed on the both end portions of the above-mentioned electromagnet portion 2. The above-mentioned electromagnet portion 2 is not specifically limited in the present invention, and in the present Embodiment 1, an article obtained by arranging in the frame 8 the electromagnet 7 consisting of one pair of E type iron cores and the winding coil portion wound thereto is used. The above-mentioned vibrator 3 is inserted in the cavity portion of the electromagnet portion 2 and is obtained by retaining two of magnets such as flat magnets 9, ferrite magnets, or rare earth magnets which are arranged at a fixed interval, on a retaining board 10. The vibrator 3 is fixed on the above-mentioned diaphragms 4 and 5 at the screw portions of end portions of the retaining board 10 with retaining fittings 11 and 12, and supported in the electromagnet portion 1. Further, the optimum dimensions (effective diameter) of the above-mentioned diaphragms with a large diameter 4 and diaphragms with a small diameter 5 can be appropriately selected by theory and trial preparation, and for example, the ratio of the diameter of diaphragms with a large diameter 4 to the diameter of diaphragms with a small diameter 5 can be made as about $\sqrt{2}$.

For the pump related to Embodiment 1, the pump body cover 1 is installed for covering the whole pump and intercepting noise, on the design of appearance, but since said cover 1 has no relation with performance, it can be eliminated. Further, in FIG. 1, cushions with steps 1*a*. FIGS. 2 and 3 are fixed on the above-mentioned frame 8, and the vibration of the pump is designed to be absorbed.

In Embodiment 1, when the above-mentioned electromagnet 7 is electrified and the vibrator 2 moves to left and right directions, the left and right diaphragms 4 and diaphragms 5 move to left and right to carry out the actions of air suction and air compression.

The above-mentioned left and right pump casing portions 6 consist of the pump casings 13*a* (pump casing at low pressure side) for the above-mentioned diaphragms with a large diameter 4 and the pump casings 13*b* (pump casing at medium pressure side) for diaphragms with a small diameter 5, the suction chambers 14*a* and 14*b* and the discharge chambers 15*a* and 15*b* which are respectively formed in the pump casings 13*a* and 13*b*, and the pump portion which consists of the left pump chambers LPL and MPL and the right pump chambers LPR and MPR; the left pump chambers LPL and MPL of the pump casing 13*a* are adjacent to the right pump chambers LPR and MPR of the pump casing 13*b*, and partitioned with the diaphragms with a small diameter 5. Further, the above-mentioned suction chambers 14*a* and 14*b* are equipped with the suction orifice 16*a* and the suction valve 16*b* so as to be linked with the above-mentioned pump chambers LPL, MPL, LPR and MPR, and the discharge chambers 15*a* and 15*b* are equipped with the discharge orifice 17*a* and the discharge valve 17*b*, respectively. Further, the outer diameter portions of the diaphragms with a large diameter 4 are sandwiched by the diaphragm stands 18 and the pump casing 13*a* which are fixed on the above-mentioned frame 8 to be supported. Further, the outer diameter portions of the above-mentioned diaphragms with a small diameter 5 are sandwiched by the diaphragm stand portions 19 which are formed in the above-mentioned casing portion 13*a* and the pump casing 13*b* through the spacer 20 to be supported. The suction portions 21*a* and 21*b* and the discharge portions 22*a* and 22*b* are respectively provided on the above-mentioned suction chambers 14*a* and 14*b* and the discharge chambers 15*a* and 15*b*. Additionally, the discharge portions 22*a* at left side and the suction portions 21*b* at right side are connected with the vent pipe (tube) 23, and the suction portions 21*b* at left side and the discharge portions 22*a* are connected with the vent pipe 24. In Embodiment 1, the suction valves 16*b* and the discharge valves 17*b* of the pump chambers LPL, MPL, LPR and MPR are installed to a lateral direction, namely, at the front portion and rear portion of the pump chambers LPL and LPR, and at the side portion of the pump chambers MPL and MPR so that the vent pipes 23 and 24 are easily connected, without being installed on the upper portions and bottom portions (lower portions) of respective pumps (lower portions on the paper of FIG. 2). Thereby, the height of the pump can be lowered.

Low pressure is generated in the pump chambers LPL and LPR which are formed by the above-mentioned diaphragms with a large diameter 4, and medium pressure is generated in the pump chambers MPL and MPR which are formed by the diaphragms with a small diameter 5.

Figure 4:
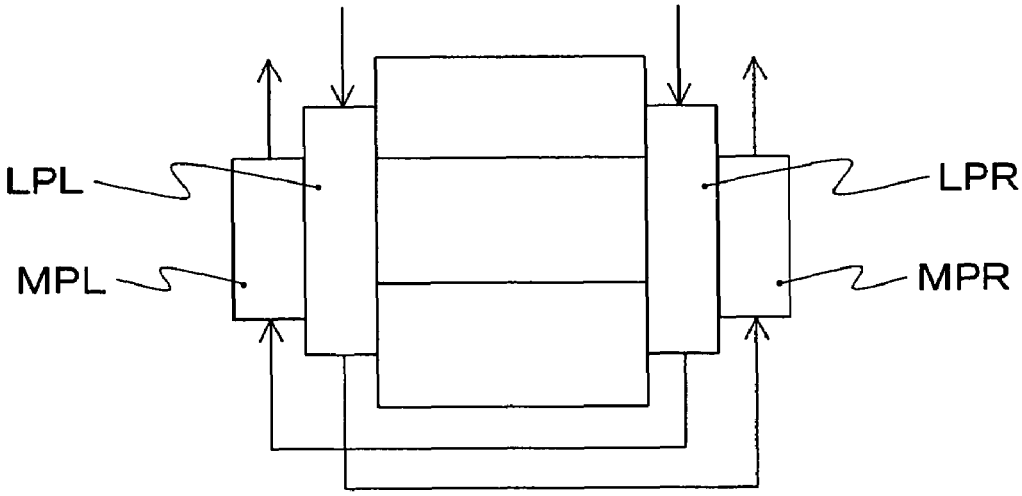
FIG. 4 is a schematic view of the pump of FIG. 1.
Figure 5:
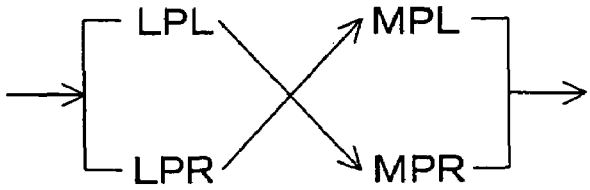
FIG. 5 is a schema illustrating the connection of the left and right pump chambers of FIG. 1.

Accordingly, as shown in FIG. 1 and FIGS. 4 to 5, the electromagnetic vibrational diaphragm pump related to Embodiment 1 is a two steps compression system pump which is 2 circuits as air circuit, wherein the diaphragm pump consists of 2 pump chambers LPL and LPR which generate low pressure and 2 medium pressure pump chambers MPL and MPR which are connected thereto, low pressure air which was generated in the pump chamber LPL (low pressure pump chamber) of the diaphragms with a large diameter 4 at left side is introduced to the pump chamber MPR (medium pressure pump chamber) of the diaphragms with a small diameter 5 at right side, low pressure air which was generated in the pump chamber LPR (low pressure pump chamber) of the diaphragms with a large diameter 4 at right side is introduced to the pump chamber MPL (medium pressure pump chamber) of the diaphragms with a small diameter 5 at left side, and is composed so as to generate medium pressure air by pumping action.

Figure 6:
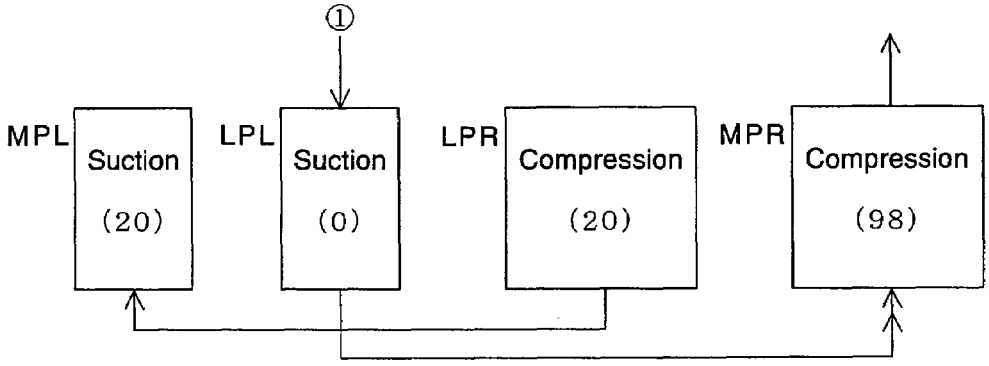
FIG. 6 is a schema illustrating the operation of the pump of FIG. 1.
Figure 6:
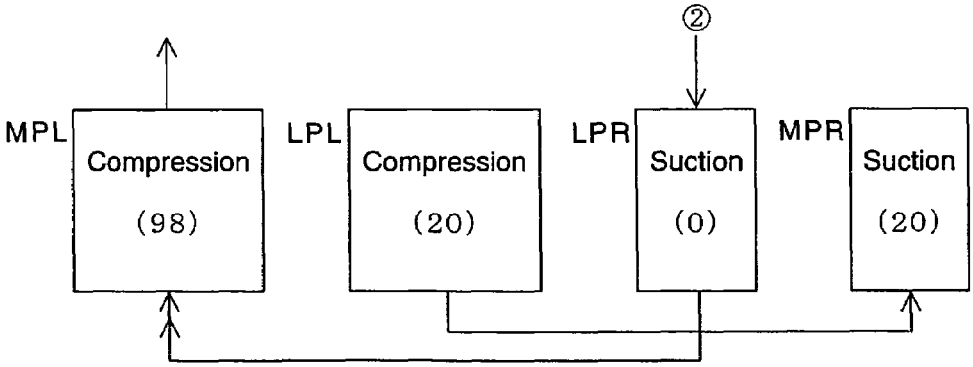

For example, as shown in FIGS. 1 and 6(*a*), the electromagnet 7 is electrified, firstly, when the vibrator 3 moves to a right direction, the diaphragms 4 and 5 at left side work to right side, and air is sucked in the pump chamber LPL from the suction portions 21*a* (airflow of 1). The pressure of the pump chamber LPL at this time is zero. Then, when the vibrator 3 moves to a left direction, air (a pressure of 20 kPa) compressed in the pump chamber LPL is introduced to the pump chamber MPR through the suction chamber 14*b* from the vent pipe 23. Then, the vibrator 3 moves to a right direction, the diaphragms 4 and 5 at right side work to right side, and the air of the pump chamber MPR is further compressed to be discharged from the discharge portion 22*b* as compressed air with a pressure of 98 kPa. At this time, the sucked air of the pump chamber MPL and the compressed air of the pump chamber LPR are a pressure of 20 kPa together.

Then, as shown in FIGS. 1 and 6(*b*), the electromagnet 7 is electrified firstly, when the vibrator 3 moves to a left direction, the diaphragms 4 and 5 at right side work to left side, and air is sucked in the pump chamber LPR from the suction portions 21*a* (airflow of 2). The pressure of the pump chamber LPR at this time is zero. Then, when the vibrator 3 moves to a right direction, air (a pressure of 20 kPa) compressed by the working at right side of the diaphragms 4 and 5 at right side is introduced to the pump chamber MPL through the suction chamber 14*b* from the vent pipe 24. Then, the vibrator 3 moves to a left direction, the diaphragms 4 and 5 at left side work to left side, and the air of the pump chamber MPL is further compressed to be discharged from the discharge portion 22*b* as compressed air with a pressure of 98 kPa. At this time, the sucked air of the pump chamber MPL and the compressed air of the pump chamber LPR are a pressure of 20 kPa together.

Thus, since the respective left and right pump portions are connected in series and work in cooperation, air becomes in a condition in which it was compressed at 2 steps, and compressed air is alternately discharged.

Figure 7:
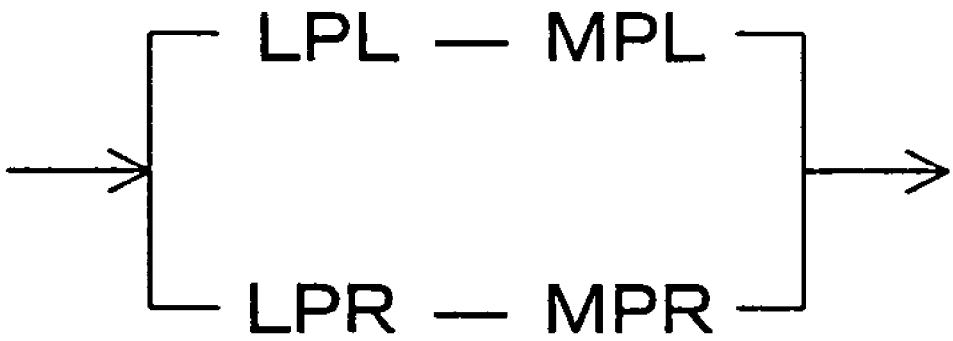
FIG. 7 is a schema illustrating other example of the connection of the left and right pump chambers.

Further, as shown in FIG. 7, the connection between the left and right pump portions is changed, and pressure can be enhanced by connecting the mutual pump portions at one side, namely, respectively connecting the pump chamber LPL and the pump chamber MPL, and the pump chamber LPR and the pump chamber MPR, but flow rate is decreased to one half.

EXAMPLES 1 AND 2

Figure 8:
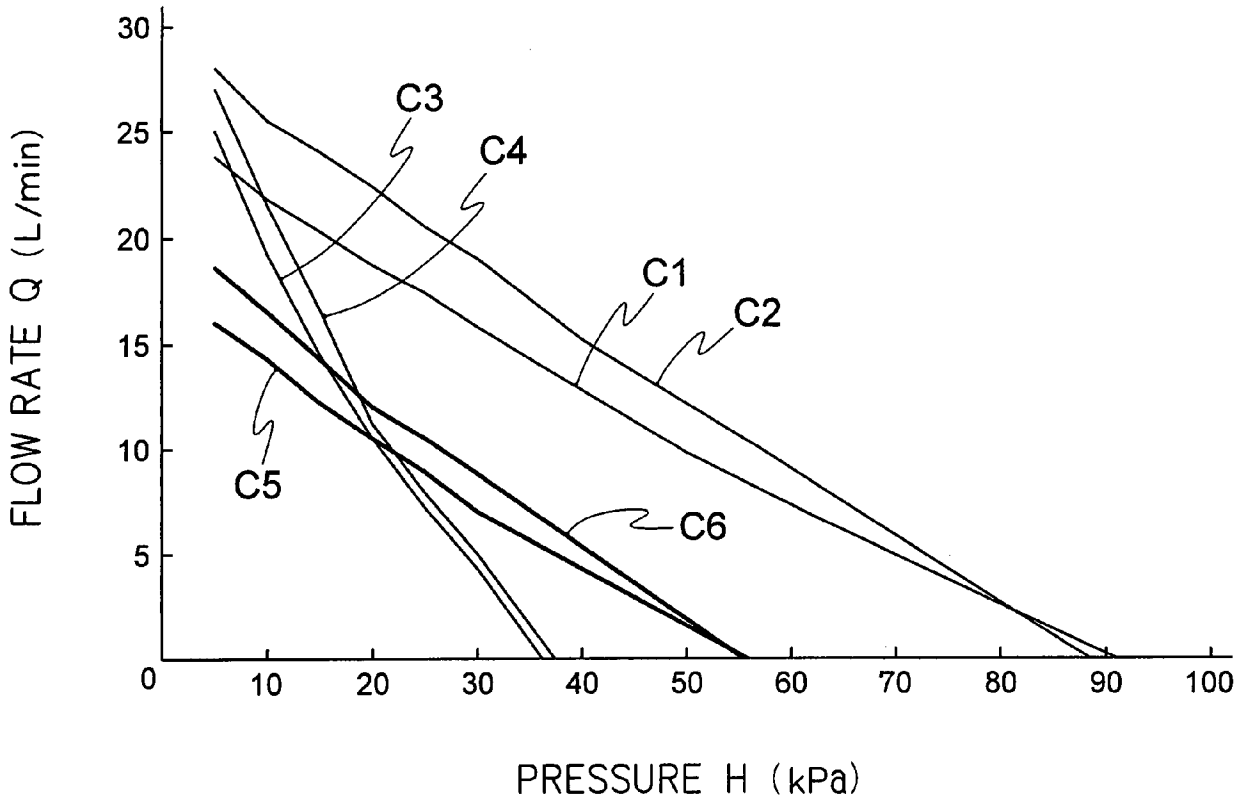
FIG. 8 is a view showing the pump of FIG. 1 and the flow rate-pressure property of the pump chamber at low pressure side and the pump chamber at medium pressure side.

Then, the flow rate-pressure property of the pump at an applied voltage of 120 V and frequencies of 50 Hz and 60 Hz is illustrated. Firstly, relation between flow rate, Q and pressure, H was studied with respect to the pump related to Embodiment 1 in which the pump chamber at lower pressure side and the pump chamber at medium pressure side were connected in series. The result is shown in FIG. 8. In FIG. 8, the curve C1 is property at 50 Hz (Example 1) and the curve C2 is property at 60 Hz (Example 2). Then, relation between flow rate, Q and pressure, H was studied with respect to the pump at low pressure side which was piped in a condition in which with respect to the left and right pump chambers, the vent pipe is piped in parallel condition, namely in FIG. 1, one end (right end portion) of the vent pipe 23 was removed from the suction portion 21*b* and connected with the suction portion 21*a* of the pump chamber LPR; and the pump at medium pressure side which was piped in a condition in which one end (right end portion) of the vent pipe 24 was removed from the discharge portion 22*a* and connected with the discharge portion 22*b* of the pump chamber MPR, and the another end (left end portion) of the vent pipe 24 was removed from the suction portion 21*b* and connected with the discharge portion 22*b* of the pump chamber MPL. The result is shown in FIG. 8. In FIG. 8, the curve C3 is the property of the pump at low pressure side at 50 Hz and the curve C4 is the property of the pump at low pressure side at 60 Hz. Further, the curve C5 is the property of the pump at medium pressure side at 50 Hz, and the curve C6 is the property of the pump at medium pressure side at 60 Hz. From FIG. 8, for example, when the rated discharge air quantity of flow rate Q is 3.5 to 5 (L/min.), the pump at medium pressure side generates higher pressure than the pump at low pressure side, and further, it is grasped that in the pump related to Embodiment 1, the pressure of the pump at lower pressure side and the pressure of the pump at medium pressure side are duplicated to generate medium pressure.

Embodiment 2

Figure 9:
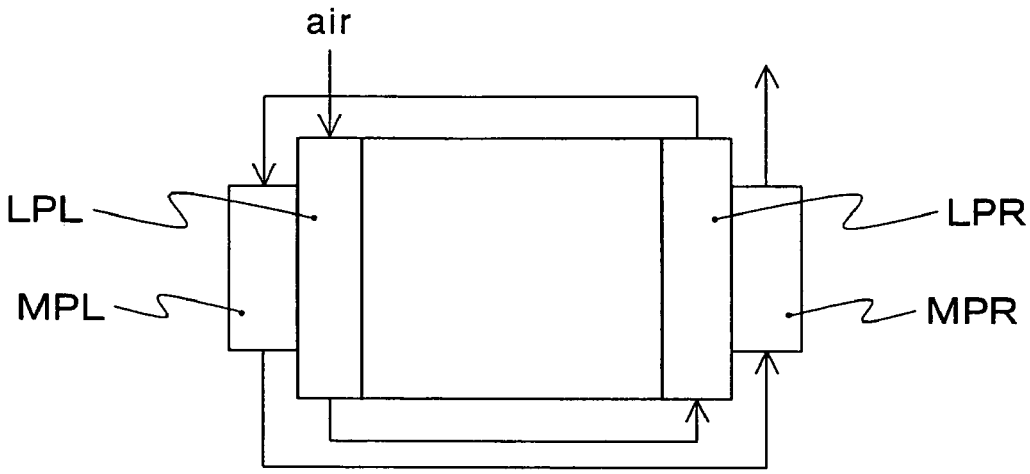
FIG. 9 is a schematic view showing the 4 steps compression of the electromagnetic vibrational diaphragm pump related to Embodiment 2 of the present invention.

The above-mentioned Embodiment 1 is constituted so that air circuit is 2 circuits with 2 steps compression, but in Embodiment 2, all of the connection between the left and right pump portions is in series, and air circuit is one circuit with 4 steps compression. Namely, as shown in FIG. 9, 4 steps compression is formed by (air) →LPL→LPR→MPL→MPR (medium pressure), or (air) →LPL→LPR→MPR→MPL→ (medium pressure), and 2-fold pressure of the pump related to the above-mentioned Embodiment 1 can be generated. However, flow rate becomes about one half. Thus, the pressure and flow rate (pump property) can be switched by changing the connection between the left and right pump portions.

Figure 10:
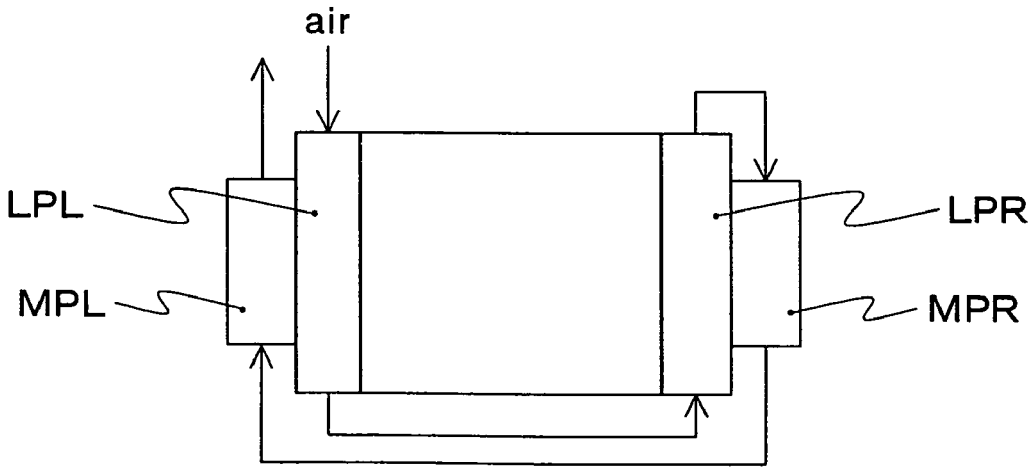
FIG. 10 is a schematic view showing the 4 steps other compression of the electromagnetic vibrational diaphragm pump related to Embodiment 2 of the present invention.

Further, the connection shown in FIG. 9 as the above-mentioned connection between the left and right pump portions is inferior in the balance of left and right driving force (load) in comparison with the connection shown in FIG. 10, and the central point of vibration is deviated from the center of electromagnet, therefore the connection shown in FIG. 10 is preferable.

EXAMPLES 3 AND 4

Figure 11:
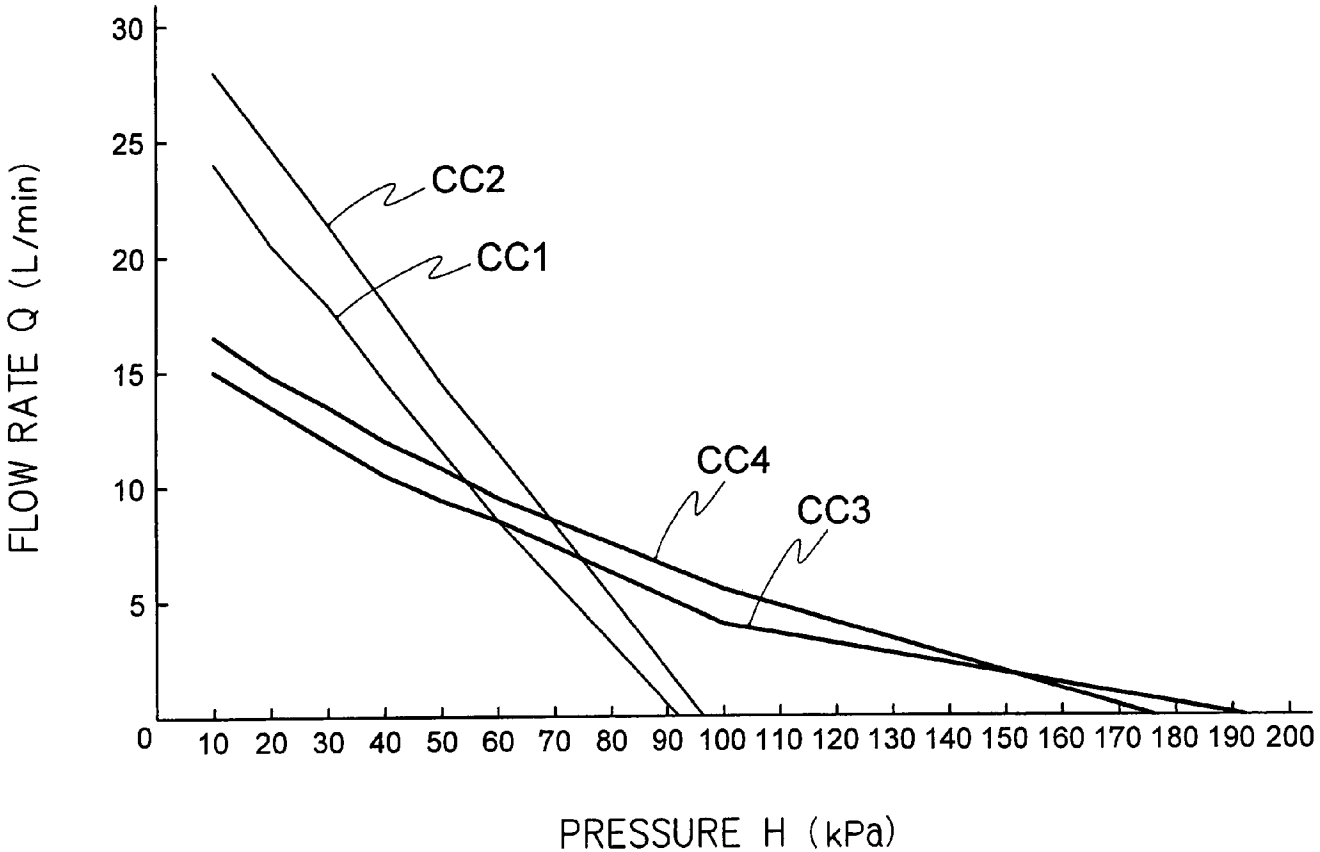
FIG. 11 is a view showing the flow rate-pressure properties of the curves CC3 (50 Hz), CC4 (60 Hz) of pumps in serial connection and the curves CC1 (50 Hz), CC2 (60 Hz) of pumps in parallel connection (pumps having different voltage at measurement from Examples 1 and 2) of FIG. 10.

Then, the flow of FIG. 10 rate-pressure property of the pump at an applied voltage of 130 V and frequencies of 50 Hz and 60 Hz is illustrated. As shown in FIG. 11, the flow rate-pressure property (Examples 3 and 4) of the curves, CC3 (50 Hz) and CC4 (60 Hz) of the pump in series connection related to Embodiment 2 improves the pressure by about 2-fold than the curves, CC1 (50 Hz) and CC2 (60 Hz) of the pump in parallel connection (pump with different voltage at measurement from the above-mentioned Examples 1 and 2), and the flow rate becomes about one half.

Embodiment 3

Figure 12:
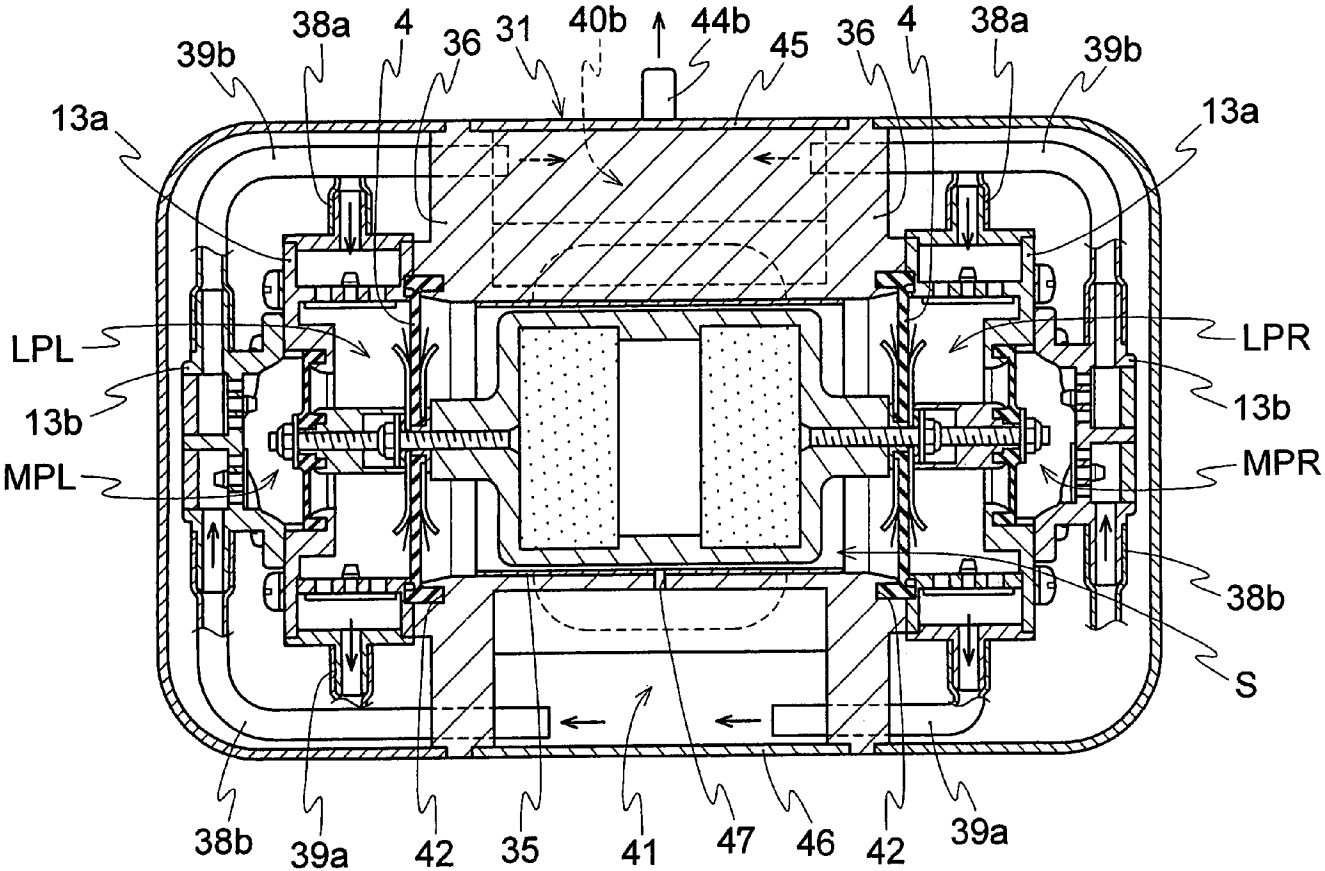
FIG. 12 is an A-A line sectional view of FIG. 13 showing the electromagnetic vibrational diaphragm pump related to Embodiment 3 of the present invention.
Figure 13:
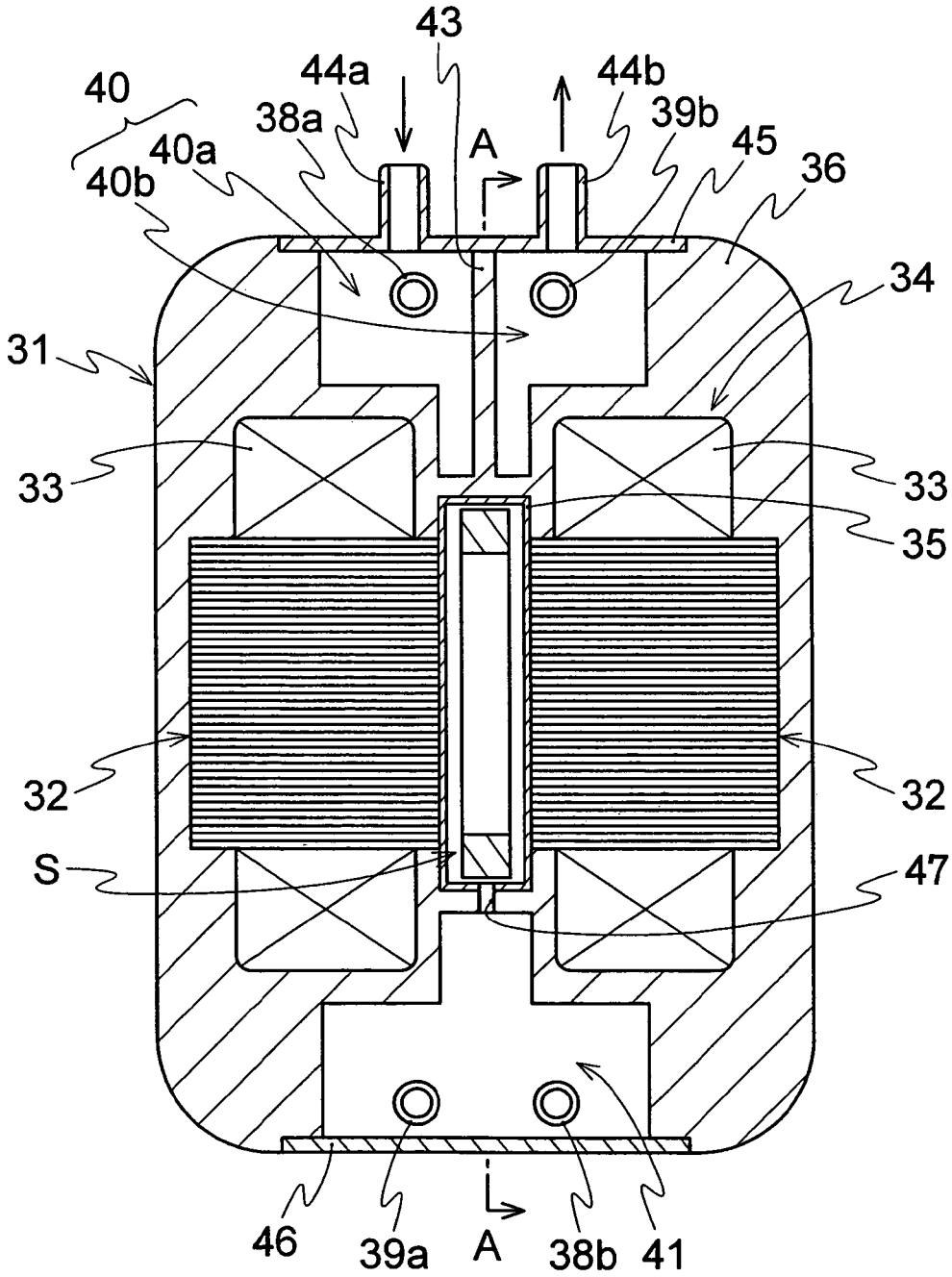
FIG. 13 is a horizontal sectional view of the pump of FIG. 12.

As shown in FIGS. 12 and 13, in Embodiment 3, the electromagnet portion 31 is composed of the electromagnet 34 consisting of the winding coil portions 33 which are assembled in a pair of E type iron cores and the inner peripheral concave portions of said iron cores, the square tubular iron core retaining tool (core) 35 which is arranged in the inner peripheral portions of the above-mentioned a pair of E type iron cores 32, and the frame 36 which is a resin molded article molded on the outer surface of the above-mentioned electromagnet 34. The iron core positioning tool 35 is arranged so that the iron cores 32 of the electromagnet portion 31 which was assembled before molding of the frame 36 is positioned against the permanent magnet 9 of the above-mentioned vibrator 10 so as to secure a fixed cavity portion S. As the material of the above-mentioned iron core retaining tool 35, a thermal resistant resin capable of enduring heat at about 150° C. at molding, a non magnetic metal such as aluminum, and the like can be used. Further, as the material of the above-mentioned frame 36, BMC (bulk mold compound) having thermal resistance and low shrinkage factor which is a molding material is desirable, and for example, an unsaturated polyester-base BMC and the like can be used. In the frame 36, there are simultaneously molded the first tank portion for vent 40 and the second tank portion for vent 41 which are linked with the left and right pump chambers at low pressure side LPL and LPR and the pump chambers at medium pressure side MPL and MPR by the suction vent pipe 38*a* and the discharge vent pipe 39*a* which are connected with the left and right pump casing 13*a* and the suction vent pipe 38*b* and the discharge vent pipe 39*b* which are connected with the left and right pump casing 13*b*, and the ring shape grooves 42 to which the diaphragms with a large diameter 4 are installed. The suction vent pipes 38*a* and 38*b* and the discharge vent pipes 39*a* and 39*b* are arranged in like manner as the above-mentioned Embodiment 1 considering the connection of the left and right pump portions with the first and second tank portions for vent 40 and 41. Further, the above-mentioned first tank portion for vent 40 can be made as the cavity portion of one chamber, but in Embodiment 3, it is separated (partitioned) to the suction tank portion 40*a* and the discharge tank portion 40*b* by the partitioning portion 43. Further, the lid 45 having the suction portion 44*a* and the discharge portion 44*b* is fixed on the suction tank portion 40*a* and the discharge tank portion 40*b*. The hermetic lid 46 is fixed on the above-mentioned second tank portion for vent 41, and the linking hole (narrow hole) 47 which penetrates the above-mentioned iron core retaining tool 35 and is linked with the hermetic space S which is hermetically sealed by the above-mentioned electromagnetic portion 31 and the diaphragms with a large diameter 4. The hole diameter of the linking hole 47 is not specifically limited in the present invention, and can be appropriately selected depending on pump output. For example, it can be about 2 to 4 mm. Further, the position of forming the linking hole 47 is not specifically limited, and can be selected at a suitable position in the second tank portion for vent 41.

Since the frame is a resin molded article in Embodiment 3, mechanical processing is hardly observed, and the parts of diaphragm are reduced, therefore parts cost and assembly cost can be reduced. Further, since the frame is a resin molded article, noise is little and safety can be also improved by double insulation.

In Embodiment 3, since the second tank portion for vent 41 and the hermetic space S are linked with the linking hole 47, pressure (air pressure) generated in the pump chambers LPL and LPR is transmitted to the pump chambers MPR and MPL, and the pressure is divided in the above-mentioned hermetic space S through the linking hole 47 and added as back pressure for the above-mentioned diaphragms with a large diameter 4.

Consequently, the pressure applied to both of the left and right sides of the diaphragms with a large diameter 4 becomes nearly the same (differential pressure=0). This plays a role such as negative feedback in an electric circuit, and stress applied to the diaphragms with a large diameter 4 is reduced. Since the diaphragms with a large diameter 4 is a rubber which can be elastically deformed, the non-linearity of the rubber itself is reflected to the spring property of the diaphragms with a large diameter 4, therefore when the pressure is applied only to the one side (pump chamber side) of the diaphragms with a large diameter 4, the non-linearity of spring constant is enlarged. Thus, when back pressure is not applied, non-linear vibration being abnormal phenomenon is generated because the spring property of the diaphragms with a large diameter 4 is non-linear. However, in Embodiment 3, non-linear vibration being abnormal phenomenon is suppressed by applying the above-mentioned back pressure to the diaphragms with a large diameter 4, and stable operation can be carried out.

Further, the frame is prepared as a resin molded article in Embodiment 3, but in the present invention, it is not limited to this and a molded article which was molded from aluminum die cast or extrusion processing can be used.

Figure 14:
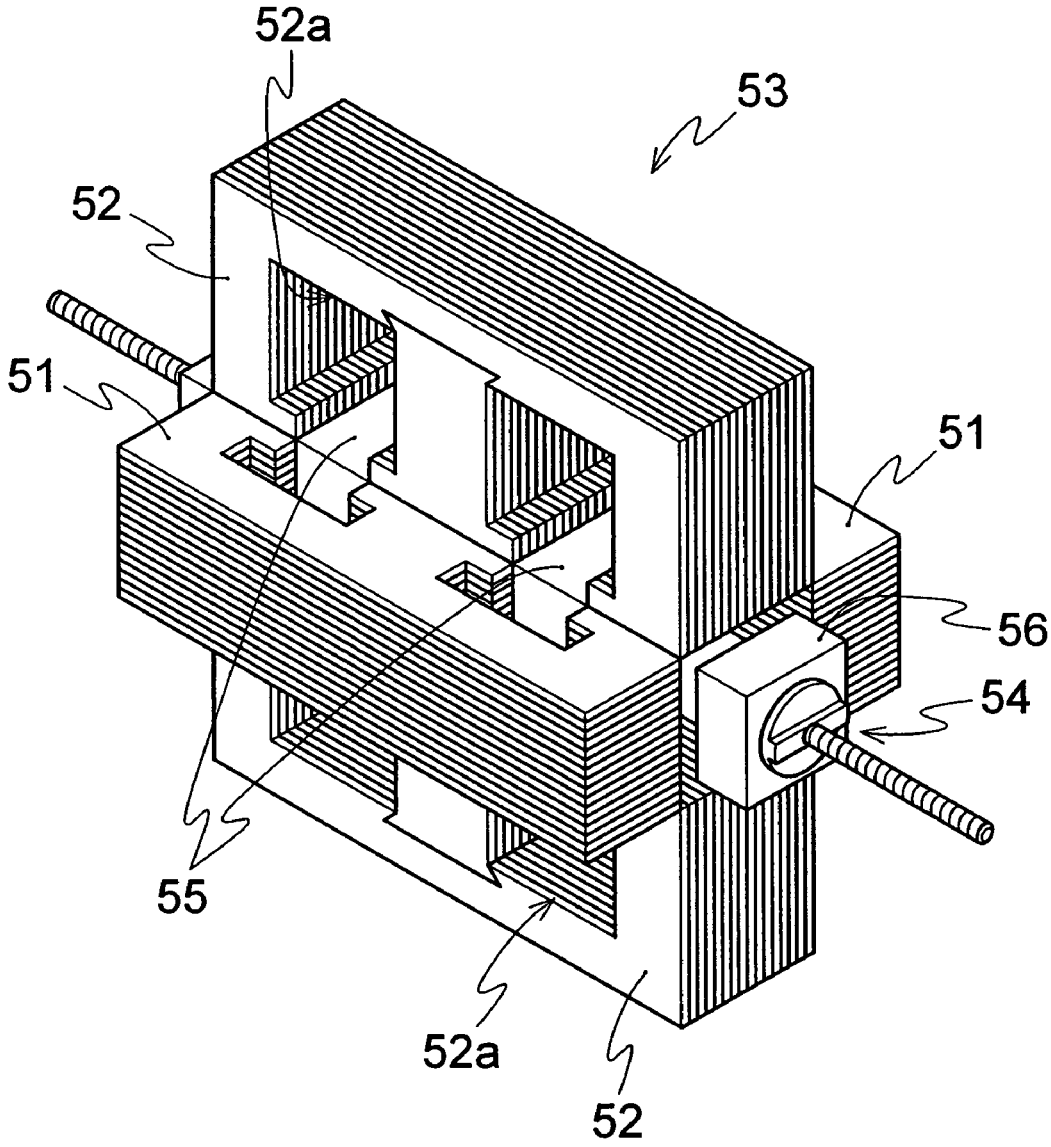
FIG. 14 is a cross-eyed view showing a 3 dimensional type electromagnet.

Further, in Embodiment 3, a two dimensional type electromagnet composed of a pair of E type iron cores (main iron cores) and the wiring coil portion, but in the present invention, it is not limited to this, and as shown in FIG. 14, an electromagnet consisting of a pair of E type iron cores with a small diameter 51 which are faced to be arranged (supplementary iron cores), a pair of E type iron cores with a large diameter (main iron cores) 52 which are arranged at a position orthogonal to said pair of E type iron cores with a small diameter 51, and the wiring coil portion (not illustrated) which is assembled in the inner peripheral concave portions 52*a* of said pair of E type iron cores with a large diameter 52 can be used. The above-mentioned iron cores with a small diameter 51 and iron cores with a large diameter 52 differ in height from a center to an outer diameter. When such electromagnet 53 is used, the magnet shape of the vibrator 54 is cubic. Namely, for the magnets 55, the external shape which was directly installed on the shaft 56 is square (a square pillar). Among a pair of the magnets 55, the polarities of an N pole and an S pole are alternately magnetized to polar anisotropic magnetic pole at 4 spots to a peripheral direction in one of the magnets 55, and the polarities of an S pole and an N pole are alternately magnetized to polar anisotropic magnetic pole at 4 spots to a peripheral direction in reverse to the magnet 55 to which the polarity of another magnet 55 faces. Further, when the frame is a resin molded article, a concave portion for the tank portion is formed in the resin fairing body at the outer peripheral site of at least one ion core with a small diameter among the above-mentioned pair of the ion cores with a small diameter.

Further, when the portion of the diaphragms with a large diameter 4 of the pump chamber LPL is damaged by fatigue and the like, the pressure of the pump chamber LPL leaks and the air pressure of the above-mentioned hermetic space S increases. Accordingly, the second linking hole (not illustrated) which is linked to the hermetic space S hermetically sealed by the above-mentioned electromagnet portion 31 and the diaphragms with a large diameter 4 is formed in the frame 36, and diaphragm pressure detecting means such as a sensor and switch which work by the raising of the pressure of the above-mentioned hermetic space S through said second linking hole and can detect the damage of the diaphragms with a large diameter 4 can be also stored in the frame 36. As the detecting means, those which push a detection diaphragm through the second linking hole and then carry out short because of deformation of a contact switch can be used.

Further, in Embodiment 3, although the linking hole 47 is formed so as to add back pressure to the diaphragms with a large diameter 4, the linking hole 47 can be eliminated when the amplitude of vibration is narrowed and pumping motion suppressing the variation of spring constant is carried out. In this case, it is enough to form 2 penetration portions for vent for connecting 2 vent pipes from the left and right pump portions in said resin portion, by eliminating the space of the above-mentioned second tank portion for vent and namely, filling the second tank portion for vent with a resin to remove the space.

Embodiment 4

In the Embodiments hitherto, the pump chamber consists of a low pressure side and a medium pressure side, and the diaphragm stand at a lower pressure side and the grooves installing the diaphragm are provided at the electromagnet portion side. The low pressure pump chamber and the medium pressure pump chamber are partitioned by the diaphragms with a small diameter for medium pressure. Further, each of the diaphragms is firmly installed at the end portion of the vibrator, and leak between both pump chambers is suppressed to the utmost.

Figure 15:
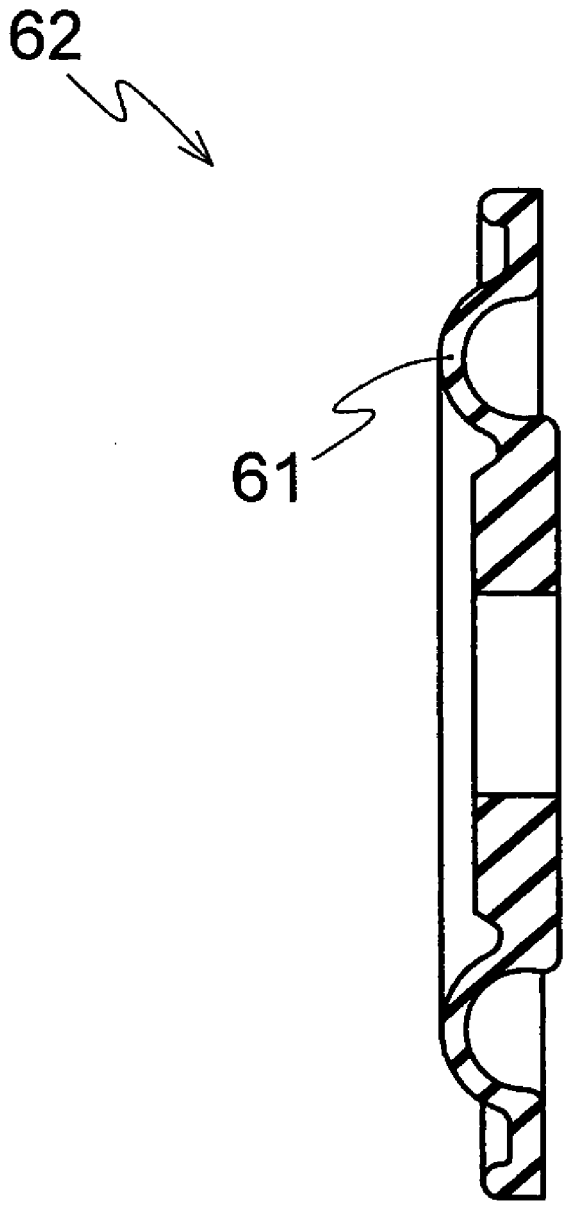
FIG. 15 is a sectional view showing the diaphragm with corrugate of the electromagnetic vibrational diaphragm pump related to Embodiment 4 of the present invention.
Figure 16:
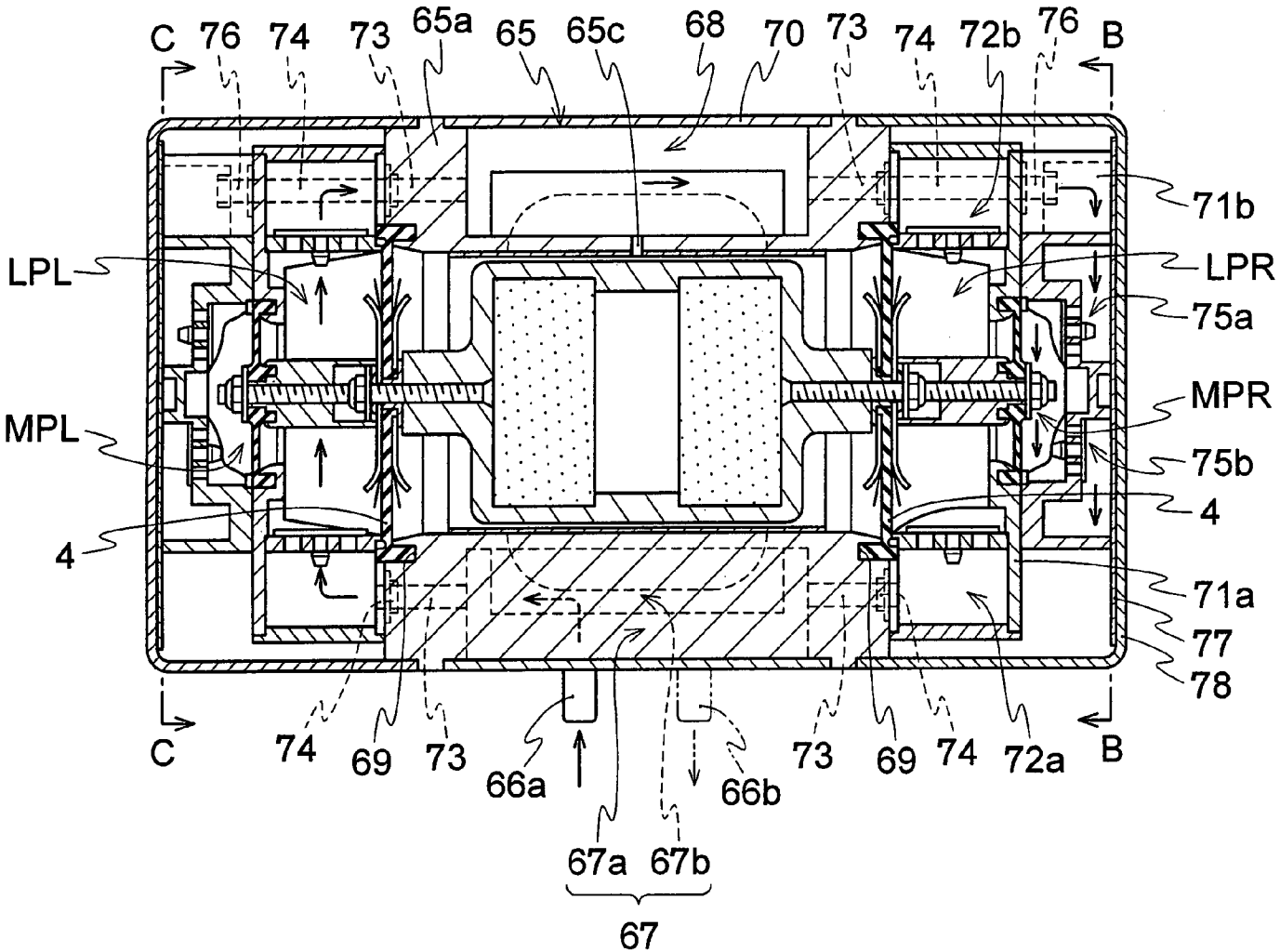
FIG. 16 is a horizontal sectional view showing the electromagnetic vibrational diaphragm pump related to Embodiment 5 of the present invention.
Figure 17:
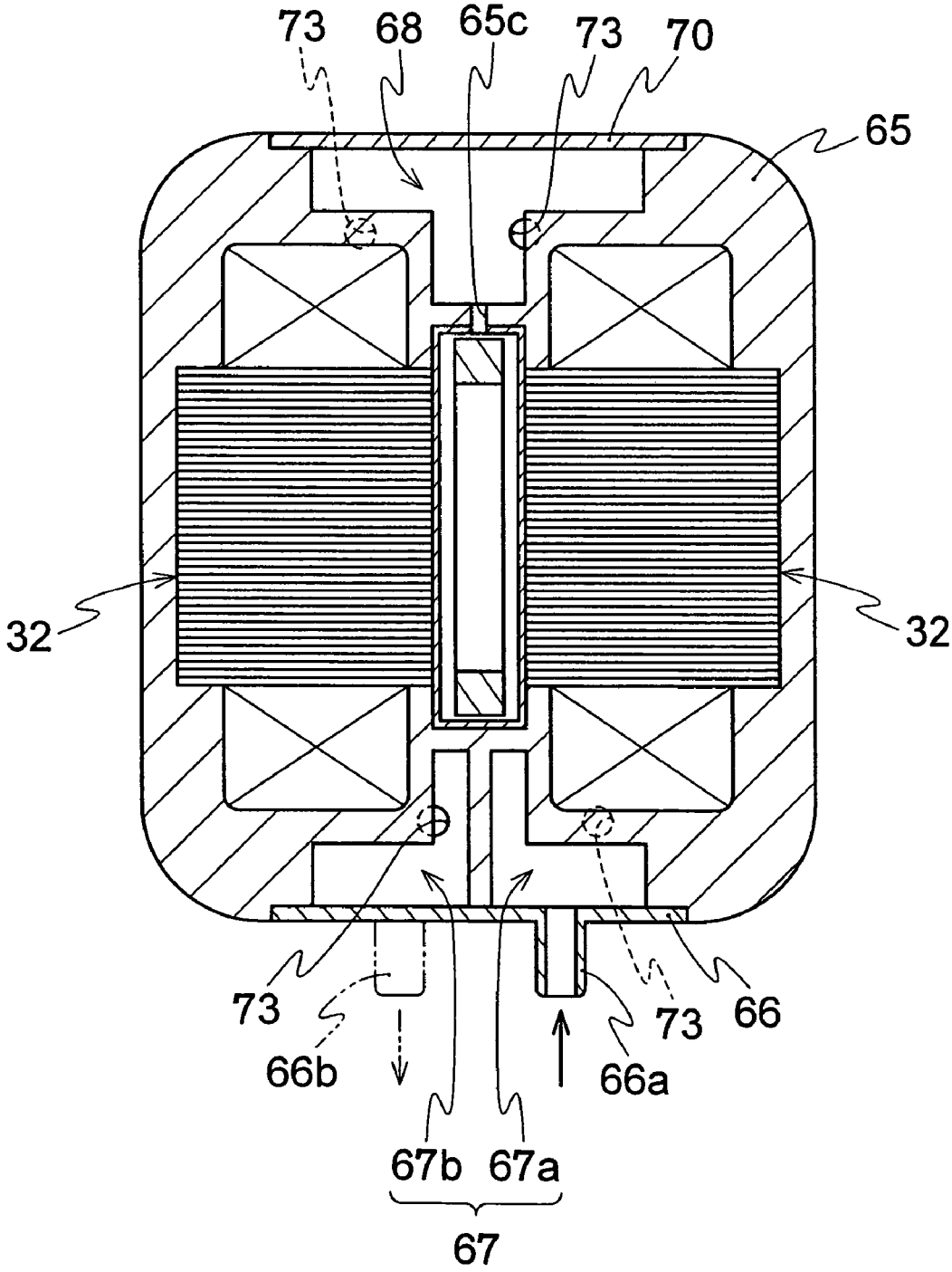
FIG. 17 is a longitudinal sectional view of the pump of FIG. 16.
Figure 18:
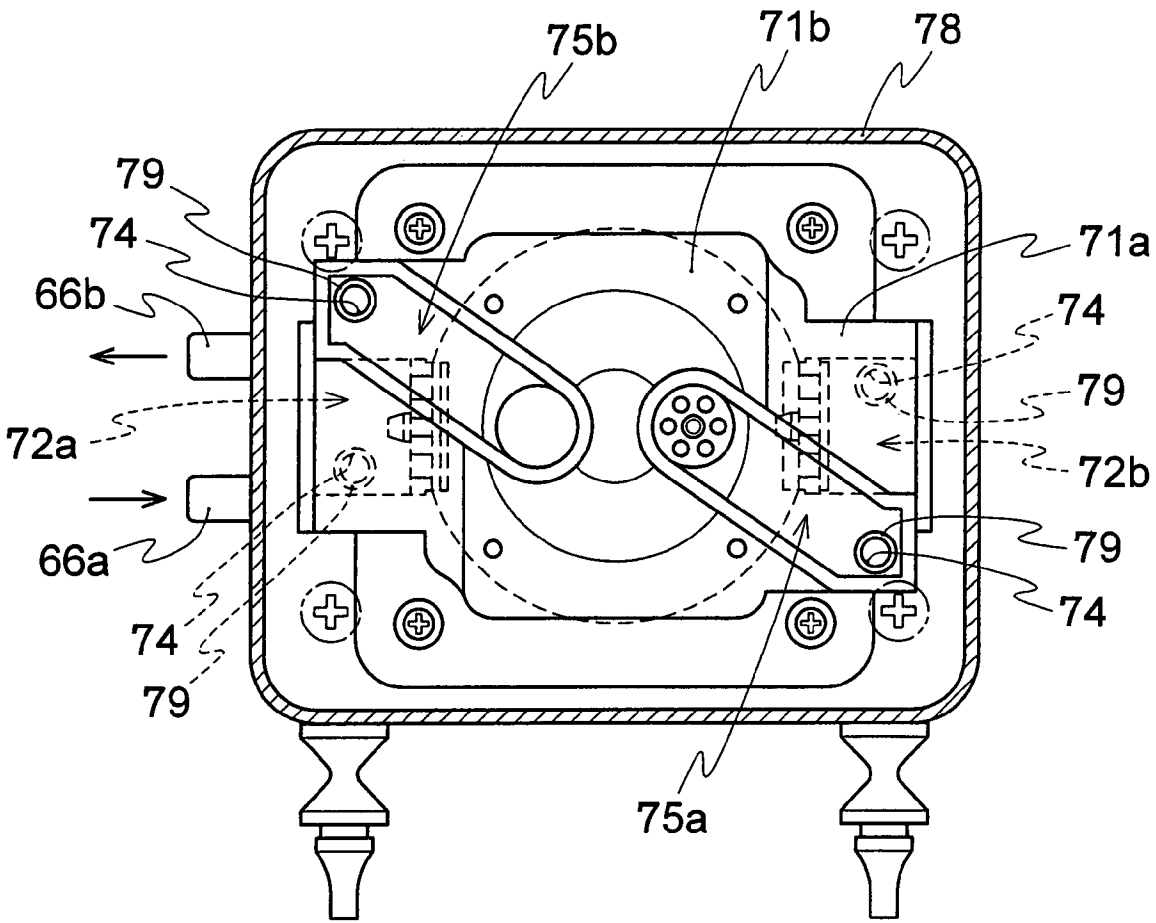
FIG. 18 is a B-B sectional view of FIG. 16.
Figure 19:
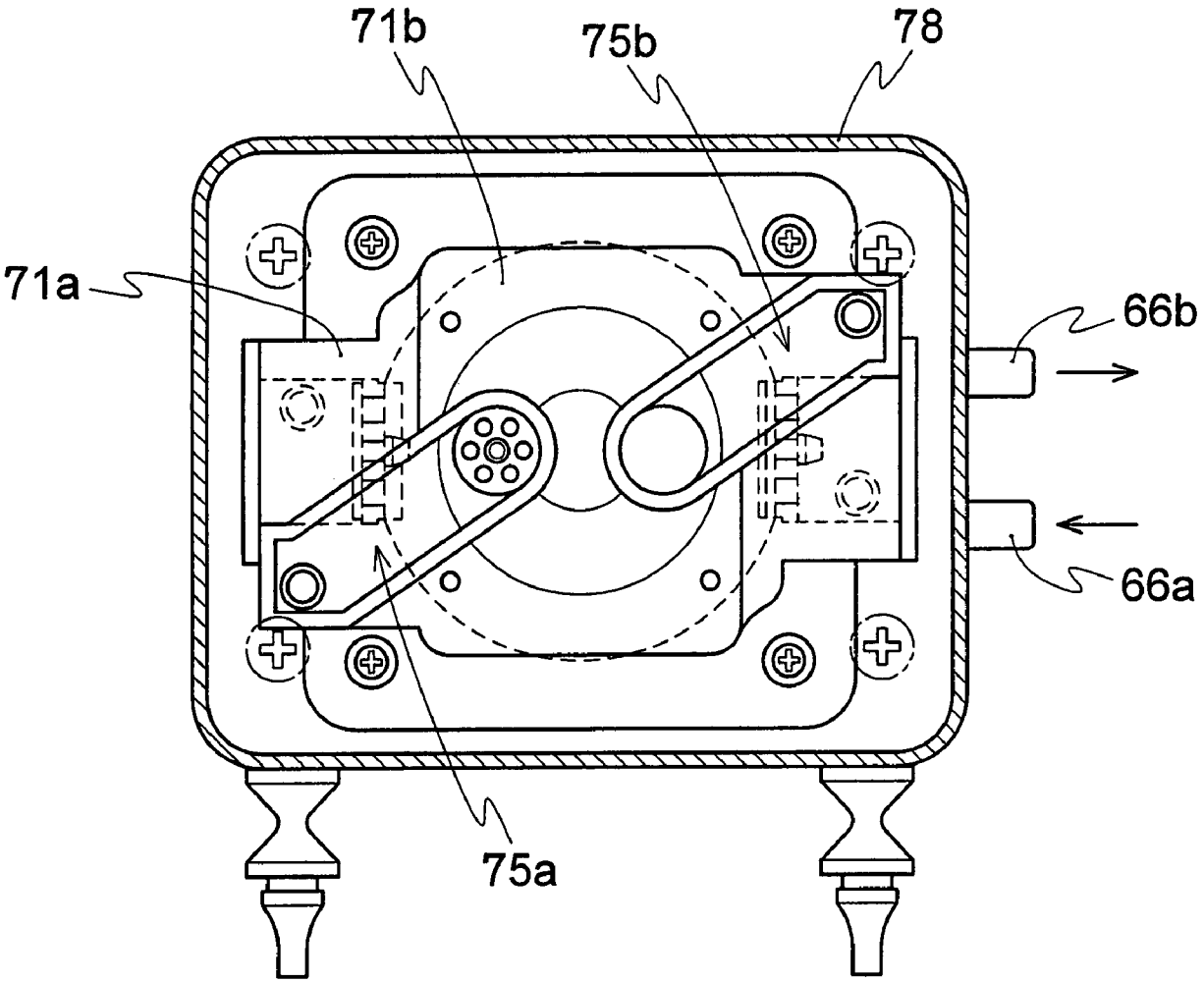
FIG. 19 is a C-C sectional view of FIG. 16.
Figure 20:
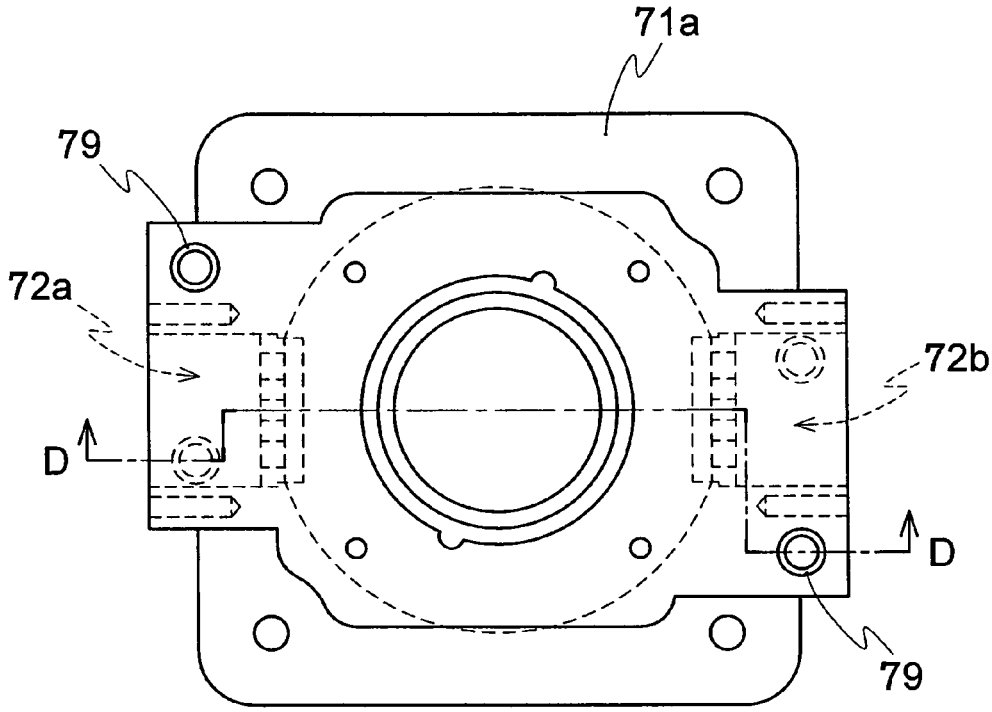
FIG. 20 is a right side view of the pump casing for low pressure of FIG. 16.
Figure 21:
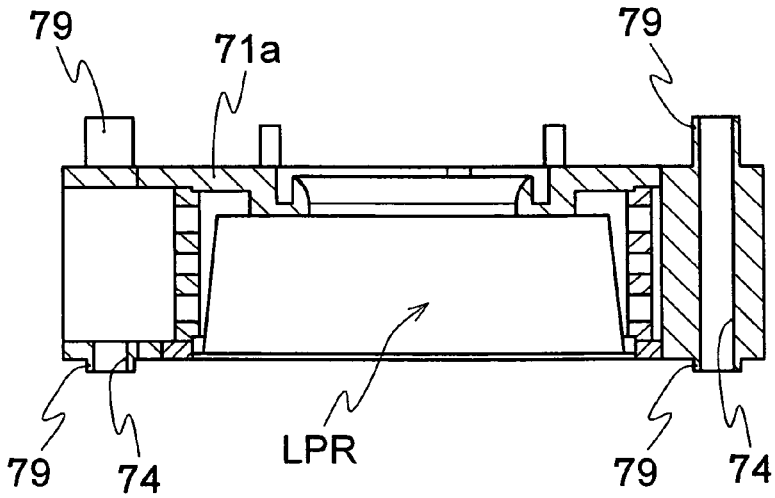
FIG. 21 is a D-D line sectional view of FIG. 20.
Figure 22:
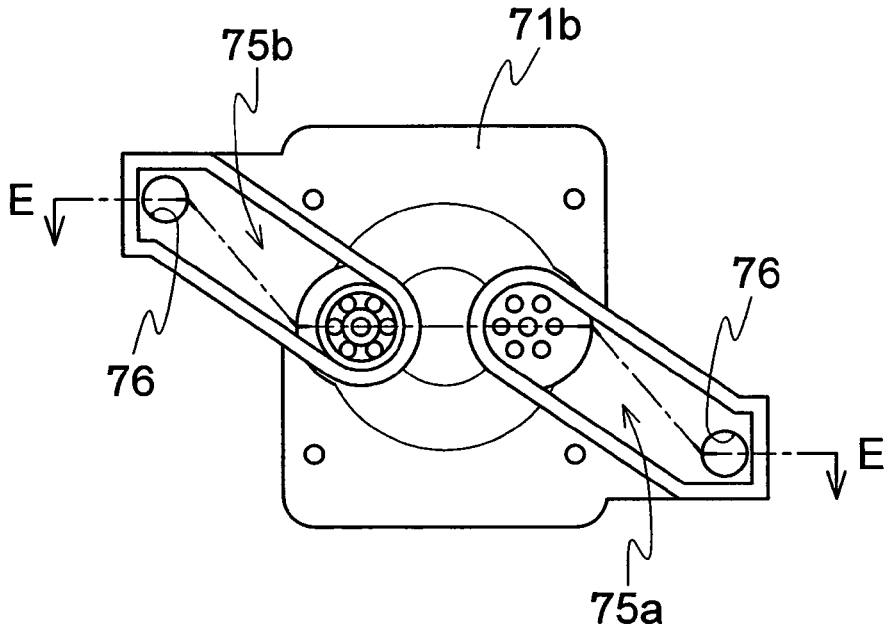
FIG. 22 is a right side view of the pump casing for medium pressure of FIG. 16.
Figure 23:
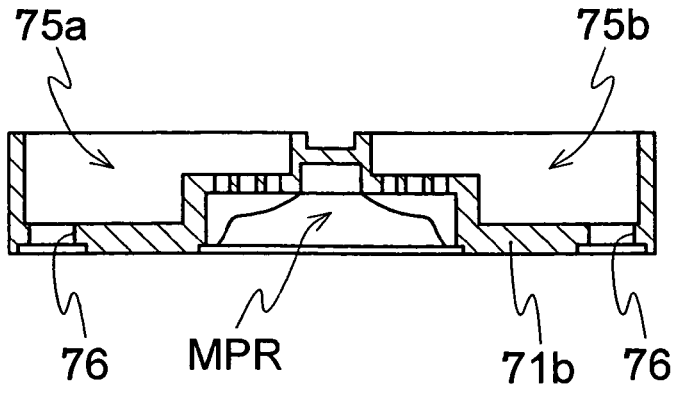
FIG. 23 is an E-E line sectional view of FIG. 22.

The diaphragms with a large diameter at the low pressure side are disc shape, and elastic strength capable of supporting the vibrator is required. However, the diaphragms with a small diameter at the medium pressure side do not require supporting force for the vibrator too much, and it is necessary to take a long stroke. The property can be freely changed depending on the diameter dimension of the diaphragms at the medium pressure side. For example, as shown in FIG. 15, it is preferable to use the corrugation type diaphragm 62 in which the wave shape (S-character shape) corrugate portion 61 which can be elastically deformed so as to take a long stroke was formed.

Embodiment 5

In the Embodiments hitherto, the respective pump casings and the tank portion for vent are connected with the vent pipe, but in the present invention, the vent pipe can be removed and pipes can be abbreviated. Namely, in Embodiment 5, as shown in FIGS. 16 to 23, the frame 65*a* is a resin molded article molded on the outer surface of the above-mentioned electromagnet 32, and there are simultaneously molded the first tank portion for vent 67 and the second tank portion for vent 68 which are linked with the suction vent pipe 66*a* and the discharge vent pipe 66*b* which are linked with the left and right pump chambers LPL, MPL, LPR and MPR, and the ring shape grooves 69 to which the above-mentioned diaphragms with a large diameter 4 are installed. The lid 66 having the above-mentioned suction portion 66*a* and the discharge portion 66*b* is installed on the first tank portion for vent 67, and the lid 70 is installed on the second tank portion for vent 68. The suction chamber 72*a* and the first tank portion for vent 67 and the discharge chamber 72*b* and the second tank portion for vent 68 which are linked with the pump chambers LPL and LPR of the pump casing 71*a* for the above-mentioned left and right diaphragms with a large diameter are linked with the passages 73 and 74 which are respectively formed in the frame 65 and the pump casing 71*a*. Further, the discharge chamber 75*b* and the first tank portion for vent 67 and the suction chamber 75*a* and the second tank portion for vent 68 which are linked with the pump chambers MPL and MPR of the pump casing 71*b* for the left and right diaphragms with a small diameter are linked with the passages 73, 74 and 76 which are respectively formed in the frame 65 and the pump casings 71*a* and 71*b*. Further, the cover 78 covering the packing 77 and the pump casings 71*a* and 71*b* which close the suction chamber 75*a* and the discharge chamber 75*b* of the pump casing 71*b* is installed.

The penetration pipe portions 79 which are inserted in the passages 76 so as to be linked with the passage 73 of the frame 65*a* and the suction chamber 75*a* and the discharge chamber 75*b* of the pump casing 71*b* are formed at the both ends of the above-mentioned passage 74, for positioning the passage of the frame 65*a* with the pump casing 71*b*, in the pump casing 71*a* in Embodiment 5. Further, it is preferable to install O-rings, packing and the like at the outer peripheral base portion of said penetration pipe portions 79 in order to prevent air leak.

Since Embodiment 5 forms passages which are directly linked with the left and right pump chambers, at the first tank portion for vent and the second tank portion for vent, the depth of said tank portion can be shallow, and the dimension of pump height can be lessened.

Further, in Embodiment 5, the first tank portion for vent 67 is separated to the suction tank portion 67*a* and the discharge tank portion 67*b* by the partition portion 80, but in the present invention, the partition portion 80 can be also eliminated.

Further, the linking hole 65*c* which is linked with the hermetic space S hermetically sealed by the above-mentioned electromagnet portion 65 and the diaphragms with a large diameter 4 is formed in the above-mentioned second tank portion for vent 68, and the pressure generated in the above-mentioned diaphragms with a large diameter 4 is going to be added to the diaphragms with a large diameter 4 as back pressure through said linking hole 65*c*, but in the present invention, the linking hole 65*c* can be also eliminated.

Embodiment 6

Figure 24:
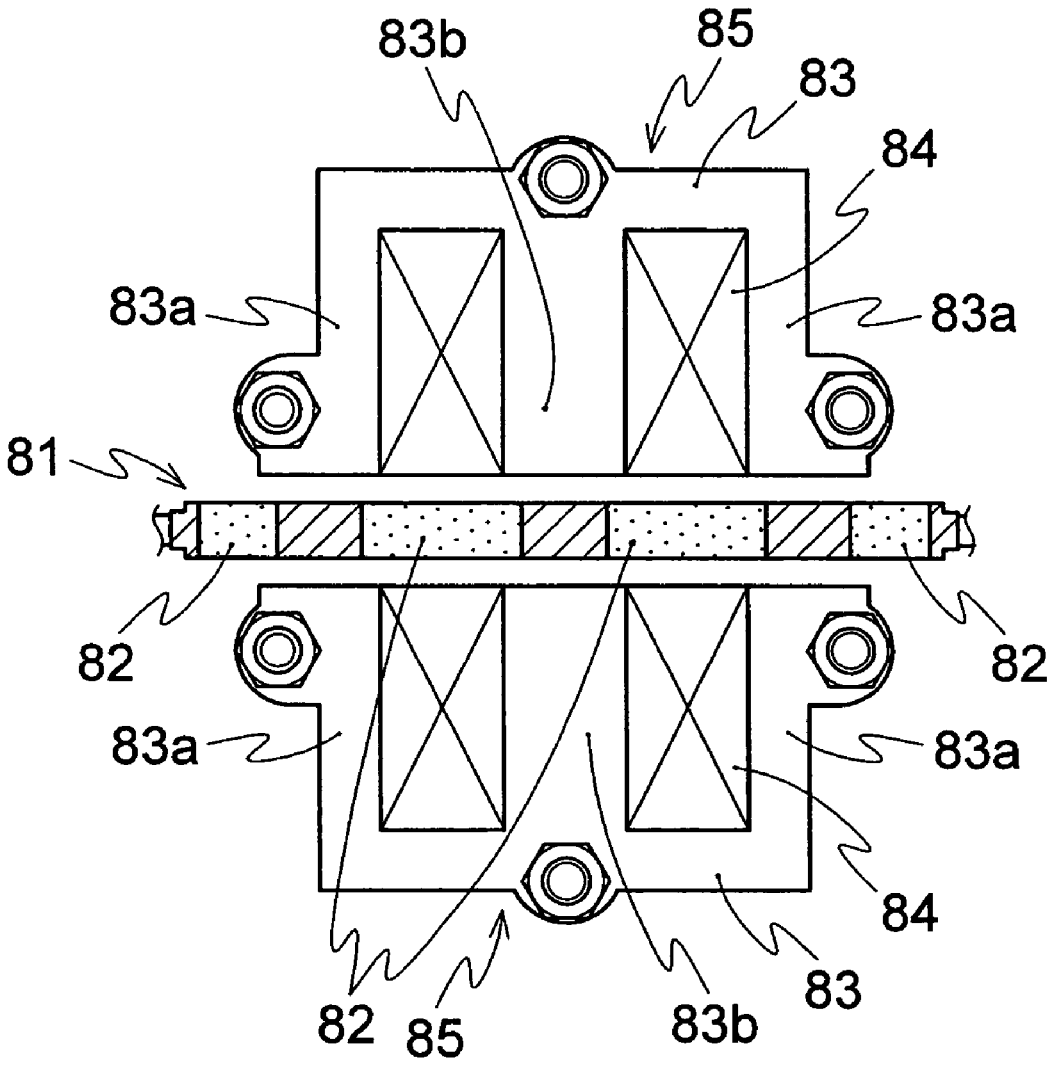
FIG. 24 is a view showing the electromagnet and vibrator in the pump related to Embodiment 6 of the present invention.

In the Embodiments hitherto, the medium pressure is designed to be generated by 2 steps compression and 4 steps compression, but in the present invention, the pressure can be increased by increasing the magnetic flux of the vibrator and increasing driving force. In Embodiment 6, as shown in FIG. 24, when one magnet 82 is respectively increased at both sides of a pair of magnets 82 of the vibrator 81 and total is increased to 4, the magnetic circuit 85 which is composed of said 4 magnets 82, a pair of E type iron cores 83 and the winding coil portions 84 is increased from one circuit to 2 circuits.

Namely, the pole width dimension of the side pole portions 83*a* (side pole) of the above-mentioned E type iron cores 83 is set as nearly the same dimension as the pole width dimension of the center pole portions 83*b* (main pole) at center, and among 4 magnets 82, and the width dimension of the magnets 82 at both end portions is set as one half of the width dimension of the magnets 82 at central portion. This is because among the magnets 82 at both end portions, the portion corresponding to one half of the width dimension of magnets at the central portion participates in the formation of magnetic path. (For example, when the vibrator approaches to left, the magnet 82 at the most right side forms a magnetic path and the magnet at the most left side does not form a magnetic path. When the vibrator approaches to right, the magnets 82 at the most left side form a magnetic path and the magnets at the most right side do not form a magnetic path. Namely, when the vibrator moves to left and right for the magnets 82 at the central portion, both sides of the width of magnets participate always in the formation of magnetic path, and to the contrary, only one half width (one side dimension) of the magnets at left and right of both ends participates in the formation of magnetic path). The magnetic circuit is composed of 2 circuits thereby.

Further, when the magnet quantity of the magnets 82 at the central portion is set as 1, the magnet quantity of the magnets 82 of end portion is one half, therefore the magnet quantity of the above-mentioned vibrator 81 is a proportion of 1+1+½+½=3. Consequently, the magnet quantity of the vibrator 81 fixing 4 of the magnets 82 is 1.5-fold of the magnet quantity of the vibrator fixing 2 conventional magnets. Accordingly, the magnetic flux is 1.5-fold and driving force is also 1.5-fold. In Embodiment 6, the decrease of electric current and the improvement of power factor are carried out therefore high efficiency can be attained by enhancing the driving force (a product of magnetic flux with electric current) generated by the above-mentioned vibrator 81.

Figure 25:
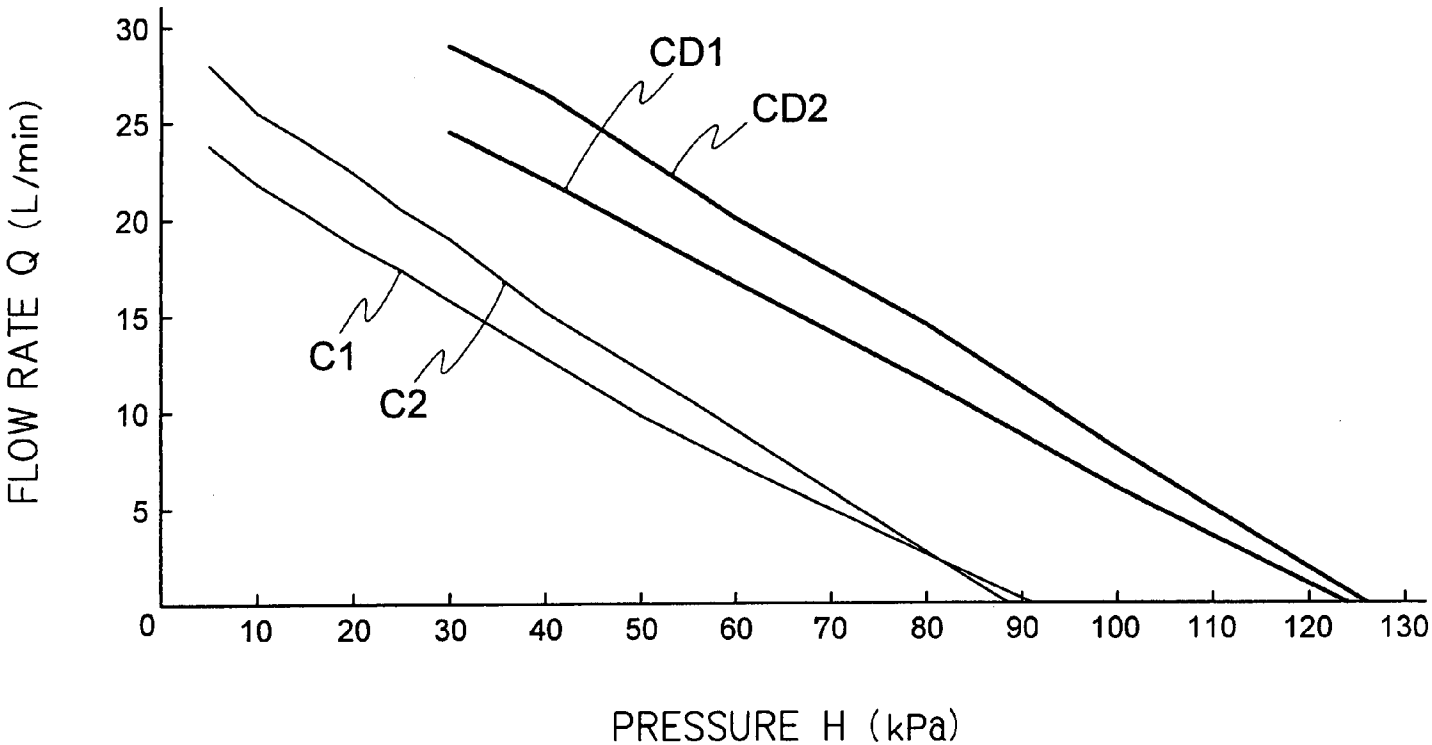
FIG. 25 is a view showing the flow rate-pressure property of the pump of FIG. 24.

Then, the flow rate-pressure property related to Embodiment 6 is illustrated. As shown in FIG. 25, the curves of the pump related to Embodiment 6, CD1 (50 Hz) and CD2 (60 Hz) are in parallel connection, and are properties at a voltage of 130 V and 50 Hz and 60 Hz respectively (Examples 5 and 6). For comparison, the properties of the curves C1 and C2 (Examples 1 and 2) of the pump related to Embodiment 1 which have been already illustrated are described together. From FIG. 25, the effect of pole side magnets appears clearly for the pump related to Embodiment 6, pressure is increased nearly in proportional to the magnet quantity, and flow rates of 6 and 8 L/min. for 50/60 Hz are respectively obtained at a pressure of 100 kPa in parallel connection. Further, the pressure is increased by 1.3 to 1.6-fold in comparison with a pump without side pole within a flow rate range of 6 to 8 L/min. Further, since the flow rates at 100 kPa were 4.0/5.5 L/min. for 50/60 Hz, respectively from the data by series connection in Embodiment 2, equal performance or more is obtained, and the flow rate is much at a pressure range of 100 kPa or less and superior.

Figure 26:
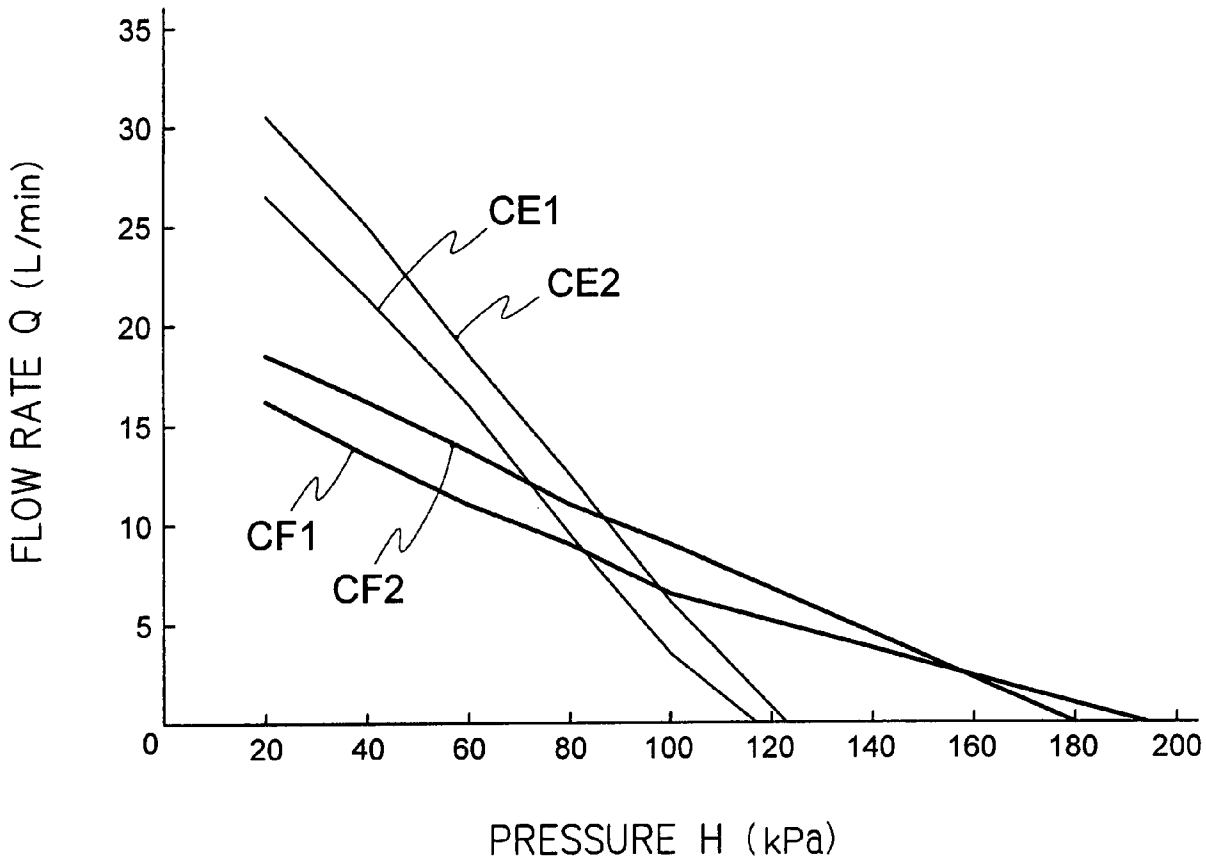
FIG. 26 is a view showing the flow rate-pressure property when the material and cavity of the magnet were changed in the pump of FIG. 24.

Properties which could not be obtained in Embodiment 1 are obtained by slight change of the shape and dimension of an electromagnet and a vibrator. Properties can be changed by changing the material of the magnet (performance) and combination. For example, desired property can be obtained by changing the material of the magnet at a central portion side and the material of the magnet at an outer side and changing thickness. For example, one example in which the material of the magnet was changed and the dimension of cavity was changed is illustrated. As shown in FIG. 26, in the electromagnet and magnets in Embodiment 6, the flow rate-pressure property of the pump in which the material of the magnet was changed from 35 MGOe to 46 MGOe of a material having high energy product and the dimension of cavity between the electromagnet and the magnet was changed to (one side+1 mm) was studied. In FIG. 26, the curves CE1 and CE2 of the pump are in parallel connection, the curves CF1 and CF2 of the pump are in series connection, and the respective values are properties at a voltage of 130 V and 50 Hz and 60 Hz (Examples 7, 8, 9 and 10). From FIG. 26, the pumps in parallel connection of Examples 7 and 8 do not increase the flow rate at 100 kPa because of influence (expansion) of cavity, but the pumps in series connection of Examples 9 and 10 improves the flow rate by 1.5-fold or more of the curves CC1 and CC2 of the pump in the above-mentioned Embodiment 2.

Further, in Embodiment 6, a 2 dimensional type electromagnet is used but in the present invention, it is not limited to this, and a 3 dimensional type electromagnet (an electromagnet consisting of a pair of E type iron cores with a small diameter, a pair of E type iron cores with a large diameter, and the wiring coil portion) can be used. When such 3 dimensional type electromagnet is used, the magnet shape of the vibrator is cubic.

Embodiment 7

Figure 27:
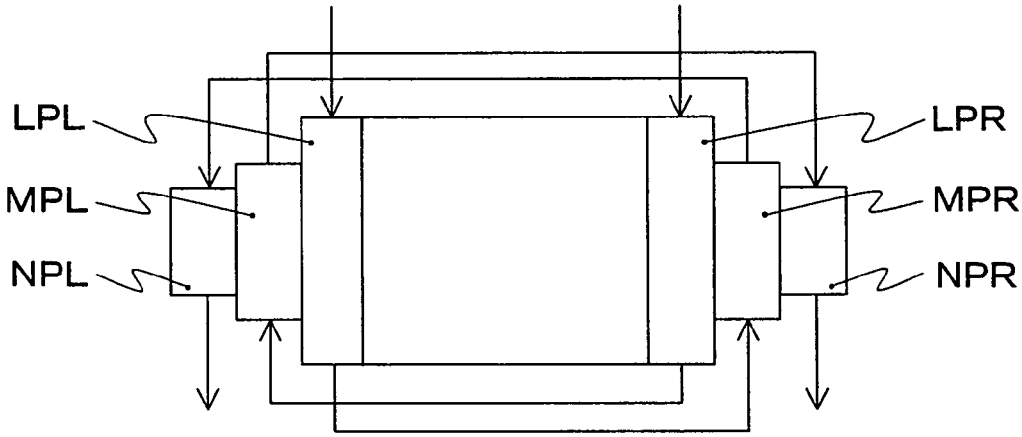
FIG. 27 is a schematic view showing the electromagnetic vibrational diaphragm pump related to Embodiment 7 of the present invention.

The pumps related to the above-mentioned Embodiments 1 and 5 are a 2 steps compression type pump, and the pump related to Embodiment 2 is a 4 steps compression type pump in which all of connections between the left and right pump portions were in series. The step number of compression can be set as more steps other than these in the present invention. For example, the steps of compression can be increased by increasing the number of the diaphragms with a small diameter (by increase of the pump portions of the diaphragms with a small diameter). For example, as shown in FIG. 27, compression becomes 3 steps by adding the pumps for medium pressure NPL and NPR, and 3 steps compression type pump can be obtained. Alternatively, a 6 steps compression type pump can be obtained by connecting all of the pump portions in series to prepare 6 steps. However, 2 steps or 4 steps are practically preferable considering the inner structure and the limitation of dimension.

Embodiment 8

The pumps related to the Embodiments hitherto could improve efficiency by the structure of a vibrator and by improving pressure according to the structure of the pump portions. Embodiment 8 has a composition of carrying out the structure of other pump portions, the structure of vibration and the vent piping between the lower pressure pump portion and the medium pressure pump portion at assembly, for designing small sizing and high efficiency. Further, production cost can be reduced thereby.

As shown in FIGS. 28 to 37, the electromagnetic vibrational diaphragm pump related to Embodiment 8 is composed of the electromagnet portion 93 consisting of the electromagnet 91 consisting of a pair of the E type iron cores 91*a* and the wiring coil portions 91*b*, or a pair of the iron cores with a small diameter, a pair of the iron cores with a large diameter which are arranged at a position orthogonal to said pair of the iron cores with a small diameter, and the wiring coil portions which are assembled in the inner peripheral concave portion of said iron cores with a large diameter and the retaining metal fittings 92, the frame 94 being a resin molded article which was molded on the outer surface of said electromagnet portion 93, the vibrator 97 which retained 4 magnets 95 on the retaining board 96, the diaphragms with a large diameter 100 and the diaphragms with a small diameter 101 which are successively linked on the screw portions 96*a* at the both end portions of said retaining board 96 using the retaining metal fittings 98 and screws 99, and the pump casing portions 102 of said diaphragms with a large diameter 100 and the diaphragms with a small diameter 101 which are fixed on the both end portions of the above-mentioned electromagnet portion 93. Further, for easily understanding it, diaphragms 100 and 101 and the retaining metal fittings 98 which link these to the vibrator 97 are eliminated in FIG. 29.

In the present Embodiment, the number of diaphragms is 4, and since the spring constant of the whole diaphragms is apt to large, the diaphragms with a small diameter at medium pressure side is set as corrugation type diaphragms having low spring constant.

Further, since the magnets 95 consisting of the rectangular main body magnets 95*a* and the 2 steps convex shape convex portion magnets 95*b* are used for the vibrator 97 in the present Embodiment, the cavity with the iron cores 91*a* is narrowed from convex portion magnets 95*b*, magnetic resistance is decreased, magnetic flux is further increased and driving force is increased. The pressure and efficiency of the pump are greatly improved thereby, and a small size pump with high efficiency can be obtained. Further, in the present invention, the surface shape of the magnets 95 is not limited to 2 steps convex shape, but one step convex shape or 3 steps convex shape, or the like can be made. Further, in the present Embodiment, the pump using 2 dimensional electromagnets 91 which are composed of a pair of the E type iron cores 91*a* and the wiring coil portions 91*b* and the flat board magnet 95 is made, but in the present invention, it is not limited to this, a pump using a steric magnet and a cubic magnet can be made.

The first tank portion for vent 103 and the second tank portion for vent 104 which are linked with the left and right pump chambers at low pressure side LPL and LPR and the pump chambers at medium pressure side MPL and MPR, and the ring shape grooves 105 to which the diaphragms with a large diameter 100 are installed are simultaneously molded in the above-mentioned frame 94. Further, the lids 107 and 108 are respectively installed on the first tank portion for vent 103 and the second tank portion for vent 104 by 4 screws 106.

Figure 28:
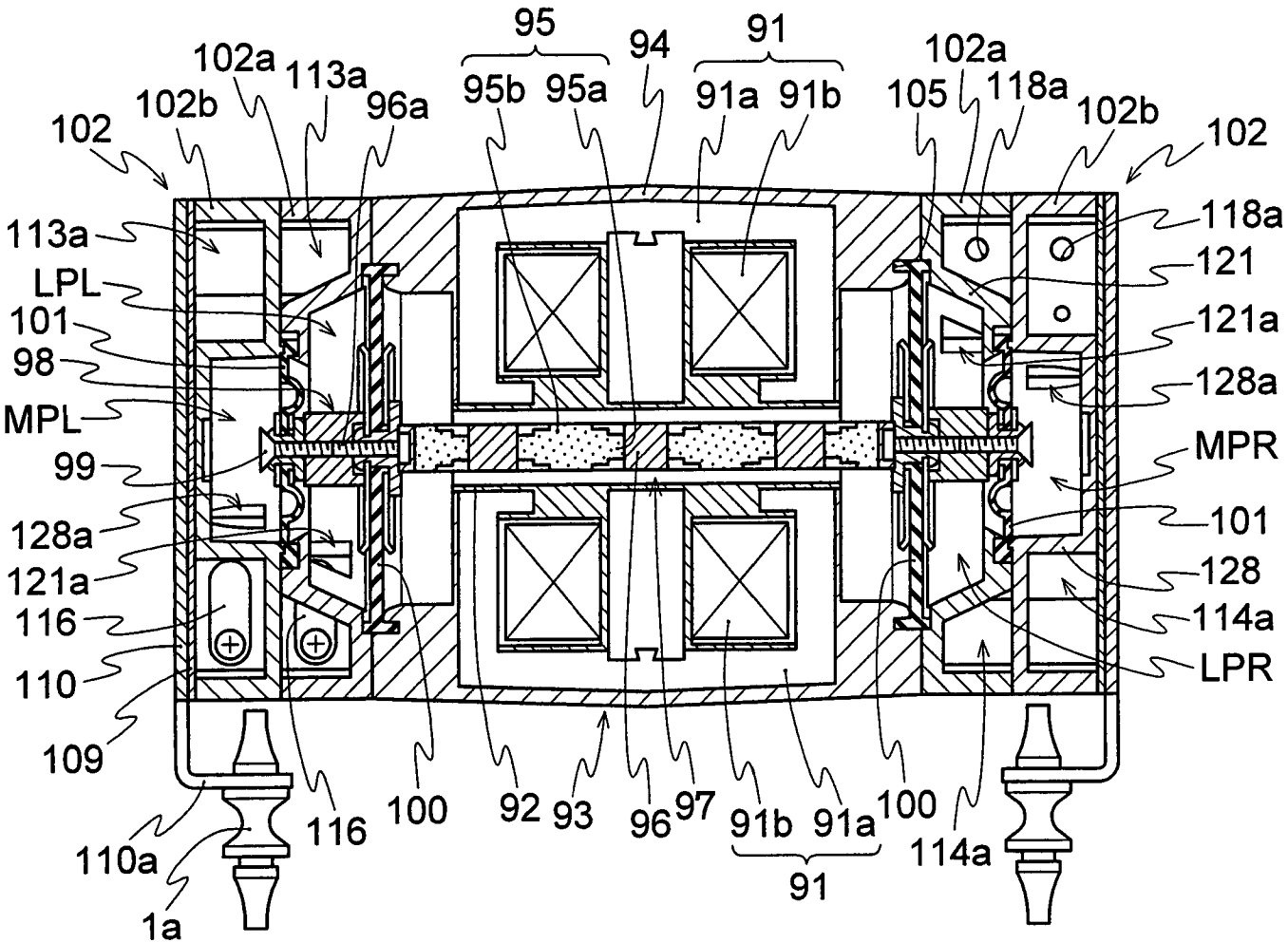
FIG. 28 is a schematic view showing the electromagnetic vibrational diaphragm pump related to Embodiment 8 of the present invention.

The above-mentioned pump casing portions 102 are equipped with the pump casing portion at low pressure side 102*a* and the pump casing portion at medium pressure side 102*b* which have nearly equal external dimension (outer diameter) or outline, that is the outer dimensions of the pump casing portions 102*a* and 102*b* are substantially the same as shown in FIG. 28. The packing 109 is installed at the end face of said pump casing portion 102*b*, and the side board 110 has legs 110*a* which fix the cushion 1*a*. The pump casing portions 102 are fixed by screwing 4 bolts 112 in the screw holes 94*a* of the frame 94 through the left and right screw hole portions at 4 corners.

The suction chamber 113*a* and the discharge chamber 114*a* which are partitioned by the suction valve 113 and the discharge valve 114, and the pump portions consisting of the left pump chambers LPL and MPL and the right pump chambers LPR and MPR are formed in the above-mentioned left and right pump casing portions 102*a* and 102*b*. The above-mentioned packing portion 109 closes the suction valve 113*a* of the pump casing portion 102*b*, the discharge valve 114*a*, and the pump chambers LPL and MPR. The suction valve 113 consists of the supporting board 115 having the suction orifice 115*a*, the valve body 116 and the stopping screw 117. The discharge valve 114 consists of the supporting board 118 having the suction orifice 118*a*, the valve body 119 and the stopping screw 120.

The cone portion 121 having the passage 121*a* which links the above-mentioned suction chamber 113*a* and the discharge chamber 114*a* is formed at the central portion of the above-mentioned pump casing 102*a*, and the four sides partitioning wall 122 is formed. The internal space of the cone portion 121 is the pump chamber LPR or the pump chamber LPL. The ring shape grooves 123*a* and 123*b* for installing the above-mentioned diaphragms with a large diameter 100 and the diaphragms with a small diameter 101 are formed at the opening end portion and bottom portion of the above-mentioned cone portion 121. Further, among 4 spaces that are formed by the above-mentioned partitioning wall 122, the screw hole portions 111 and the suction valve 113 are provided in one space on one diagonal line, and the passage 124 is formed. The screw hole portions 111 and the discharge valve 114 are provided in another space, and the passage 125 is formed. Further, the screw hole portions 111 are provided in one space on another diagonal line, and the pump chambers MPR (MPL) which are formed in the pump casing portion 102*b*, and the passages 126 and 127 which are linked with the suction chamber 113*a* and the discharge chamber 114*a* are provided.

The columnar portion 128 with a bottom having the passage 128*a* which is linked with the above-mentioned suction chamber 113*a* and the discharge chamber 114*a* is formed at the central portion of the above-mentioned pump casing 102*b*, and the four sides partitioning wall 129 is formed. The inner space of the columnar portion 128 is the pump chamber MPR or the pump chamber MPL. The ring shape grooves 128*b* for installing the above-mentioned diaphragms with a small diameter 101 are formed on the opening end portion of the above-mentioned columnar portion 128. Further, among 4 spaces which are formed by the above-mentioned partitioning wall 129, the screw hole portions 111 and the suction valve 113 are provided in one space on one diagonal line, and the screw hole portions 111 and the discharge valve 114 are provided. Further, in FIG. 35, the passage 130 and the suction chamber 113*a* are linked by the notching portion 129*a* which is formed on the partitioning wall 129 at left side, and the discharge chamber 114*a* and the passage 131 are linked by the notching portion 129*a* which is formed on the partitioning wall 129 at right side. Further, the screw hole portions 111 are provided in space on another diagonal line, and the pump chambers MPR (MPL) which are formed in the pump casing 102*b* through the above-mentioned passages 126 and 127 and the passages 130 and 131 which is linked with the suction chamber 113*a* and the discharge chamber 114*a* are formed.

Figure 37:
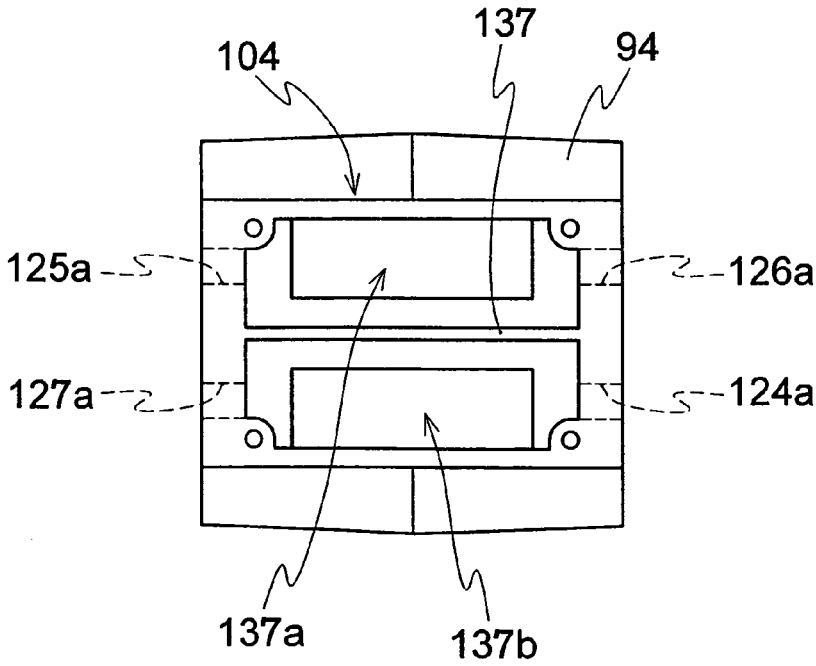
FIG. 37 is a side view of the second tank portion for vent of FIG. 28.

The inside of the above-mentioned first tank portion for vent 103 is partitioned to the suction tank portions 133*a* and 133*b* and the discharge tank portion 134 by the partitioning wall 132. The passages 124 and 126 of the left and right pump casings 102*b* and the passages 124*a* and 126*a* which are linked with the passages 125 and 127 and the passages 125*a* and 127*a* are formed. The suction portions 135*a* and 135*b* which are linked with the suction tank portions 133*a* and 133*b*, and the discharge portion 136 which is linked with the discharge tank portion 134 are formed on the lid 107 which is installed in the tank portion 103. Further, as shown in FIG. 37, the above-mentioned second tank portion for vent 104 is partitioned to 2 vent chambers 137*a* and 137*b* by the partitioning wall 137. The passages 125 and 127 of the left and right pump casings 102*a* and the passages 125*a* and 127*a* which are linked with the passages 124 and 126 and the passages 124*a* and 126*a* are formed. Further, the linking hole which is linked with the hermetic space which is hermetically sealed by the above-mentioned electromagnetic portion 93 and the diaphragms with a large diameter 100 can be also formed in the second tank portion for vent 104 in like manner as the above-mentioned Embodiment 3.

Then, the suction of air which is generated by operation of the diaphragms 100 and 101 after electrifying the above-mentioned electromagnet 91 and the movement of the vibrator 97 to left and right direction and the flow of discharged air (air circuit) are illustrated.

Figure 29:
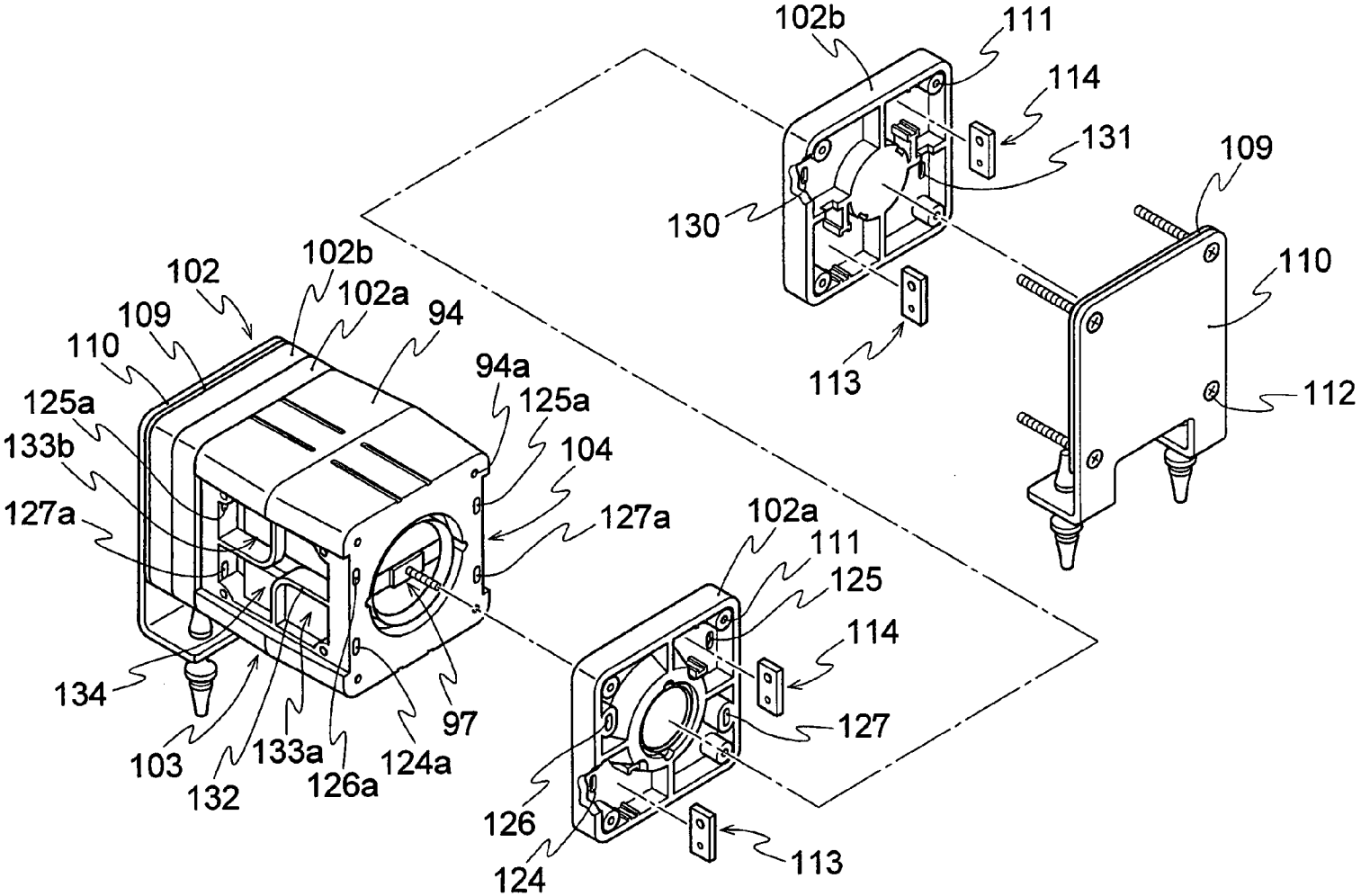
FIG. 29 is a partially decomposed cross-eyed view of the pump of FIG. 28.
Figure 30A:
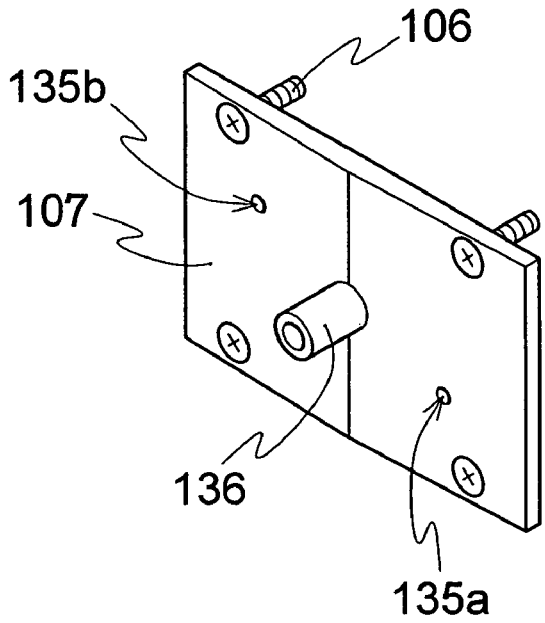
FIG. 30(*a*) is a cross-eyed view showing the lid of the first tank portion for vent and the lid of the second tank portion for vent.
Figure 30B:
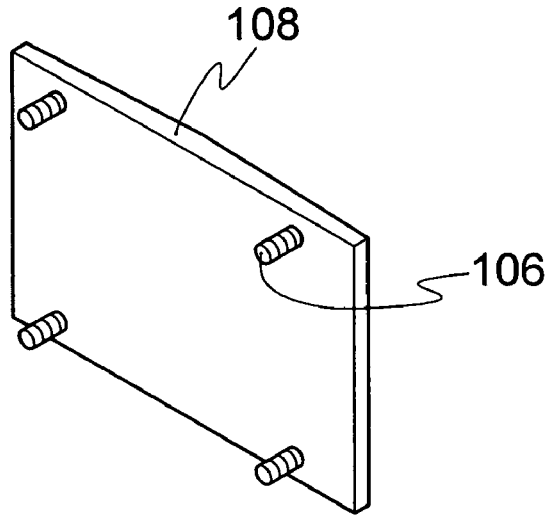
Figure 31:
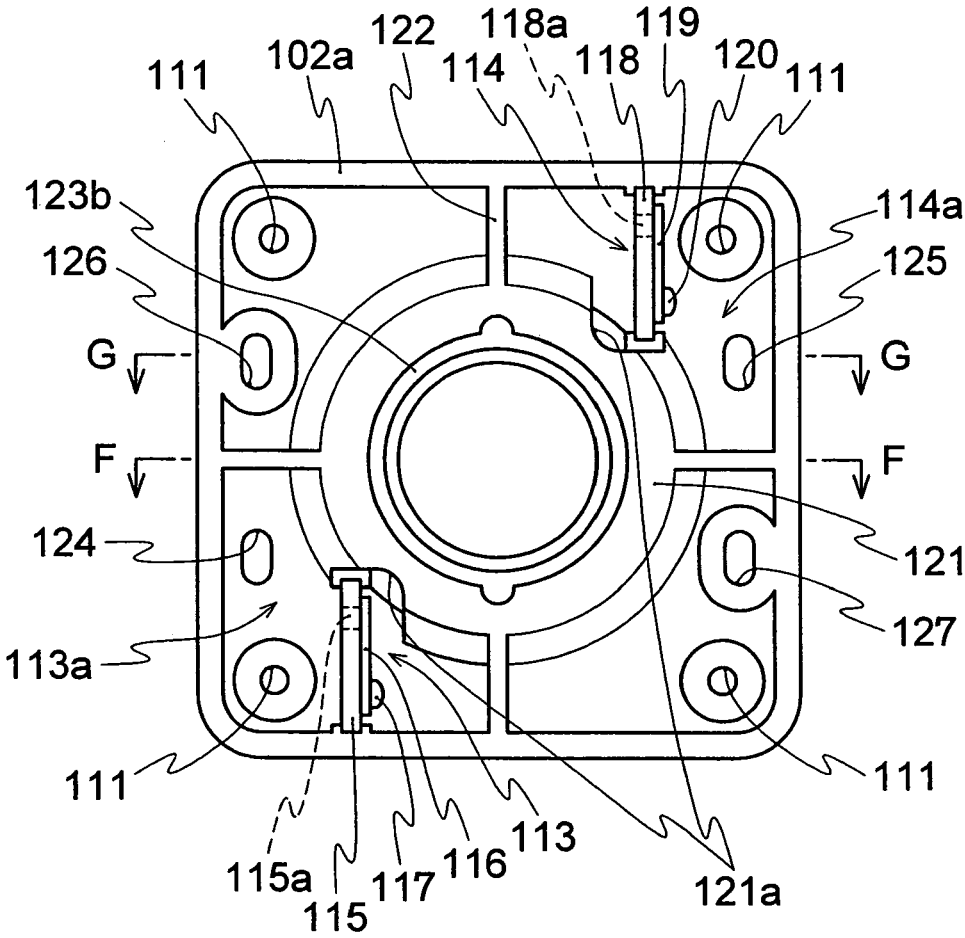
FIG. 31 is a right side view of the pump casing for the diaphragm with a large diameter of FIG. 28.
Figure 32:
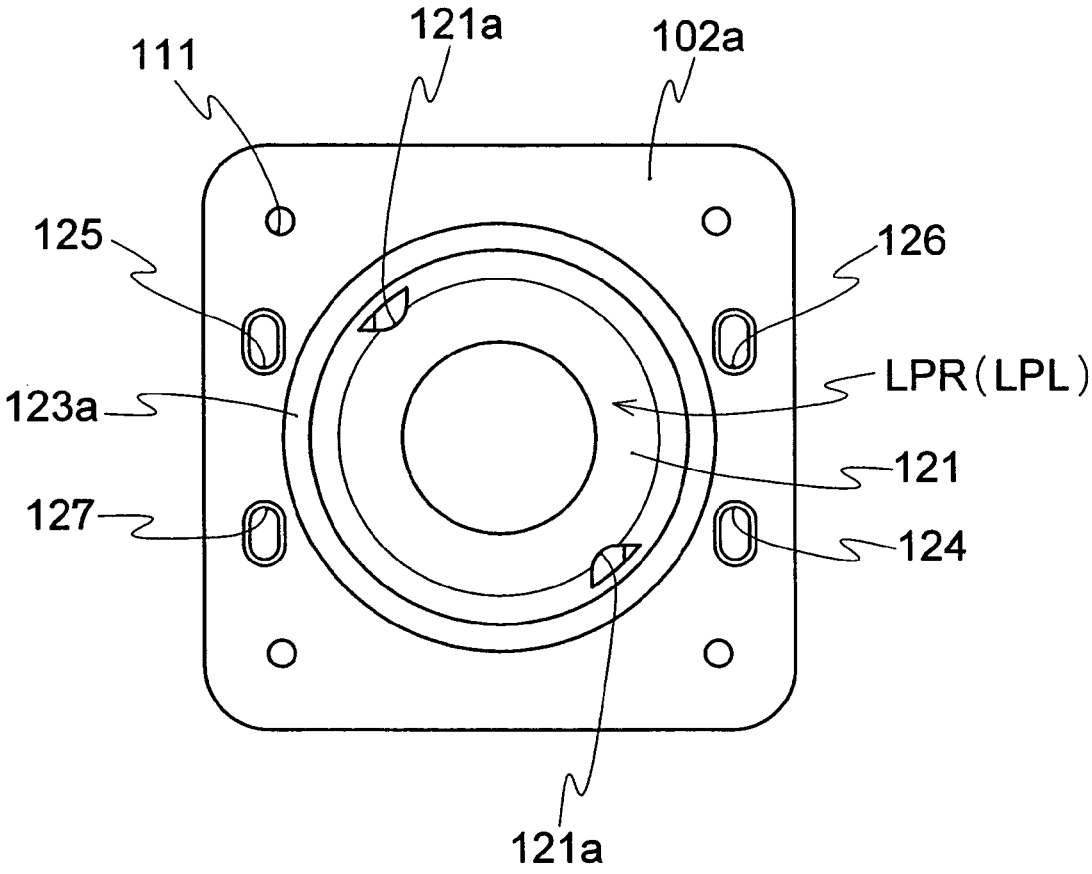
FIG. 32 is a left side view of the pump casing for the diaphragm with a large diameter of FIG. 28.
Figure 33:
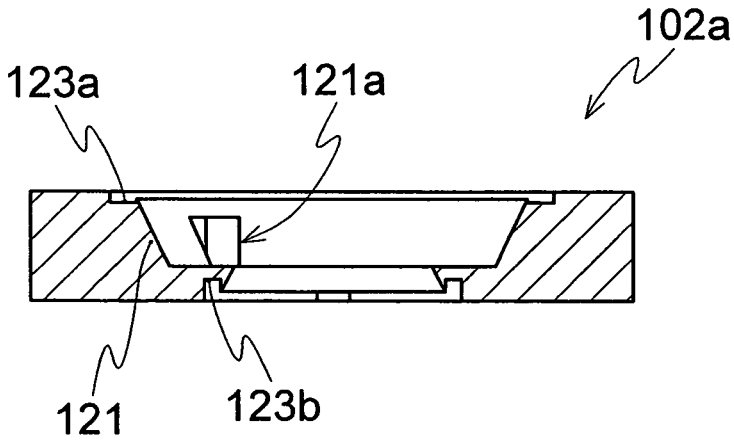
FIG. 33 is an F-F line sectional view of FIG. 31.
Figure 34:
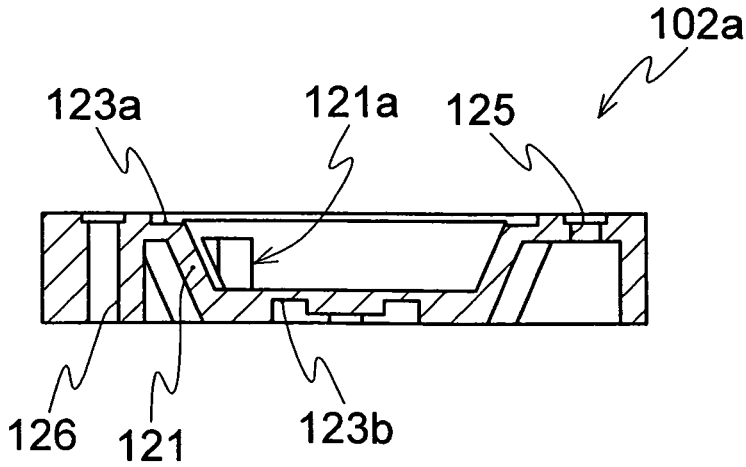
FIG. 34 is a G-G line sectional view of FIG. 31.
Figure 35:
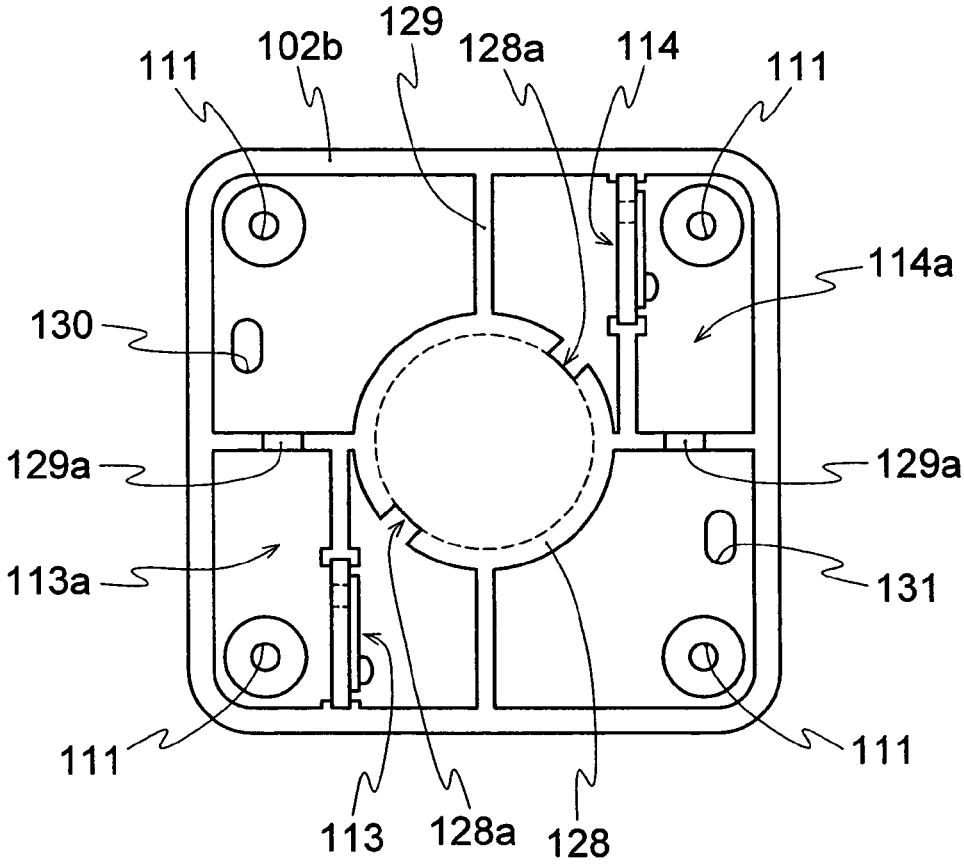
FIG. 35 is a right side view of the pump casing for the diaphragm with a small diameter of FIG. 28.
Figure 36:
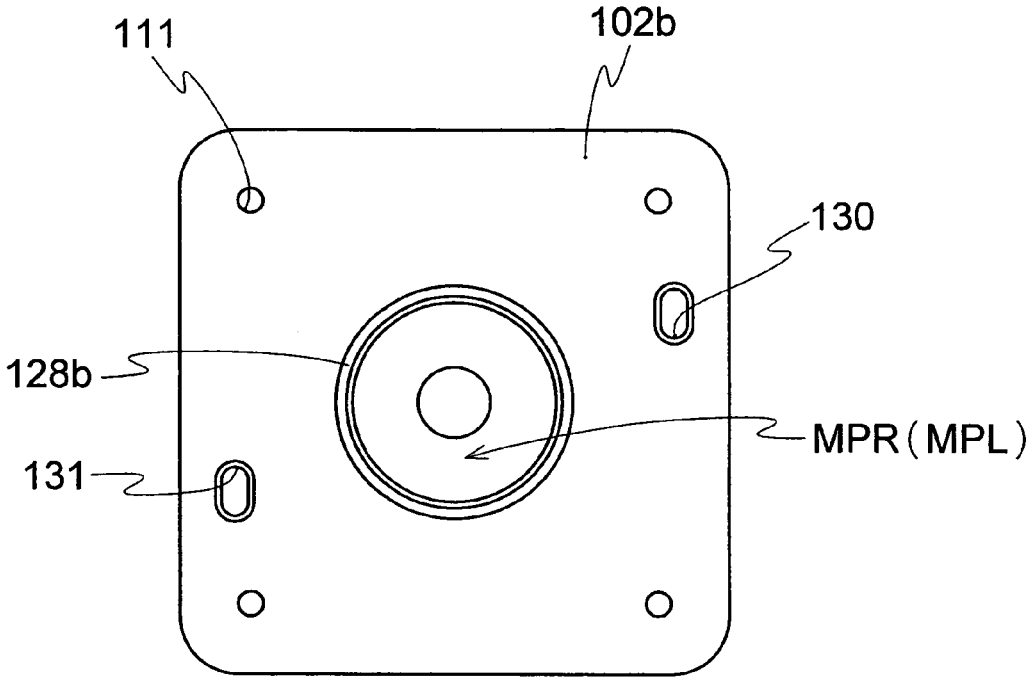
FIG. 36 is a left side view of the pump casing for the diaphragm with a large diameter of FIG. 28.
Figure 38A:
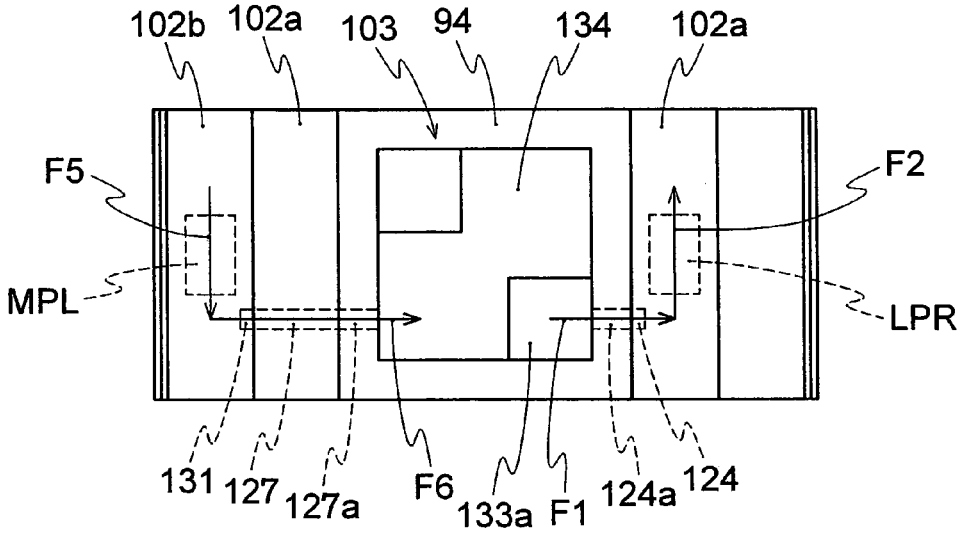
FIG. 38(*a*) is a schema illustrating airflow viewed from the first tank portion for vent of FIG. 28.
Figure 38B:
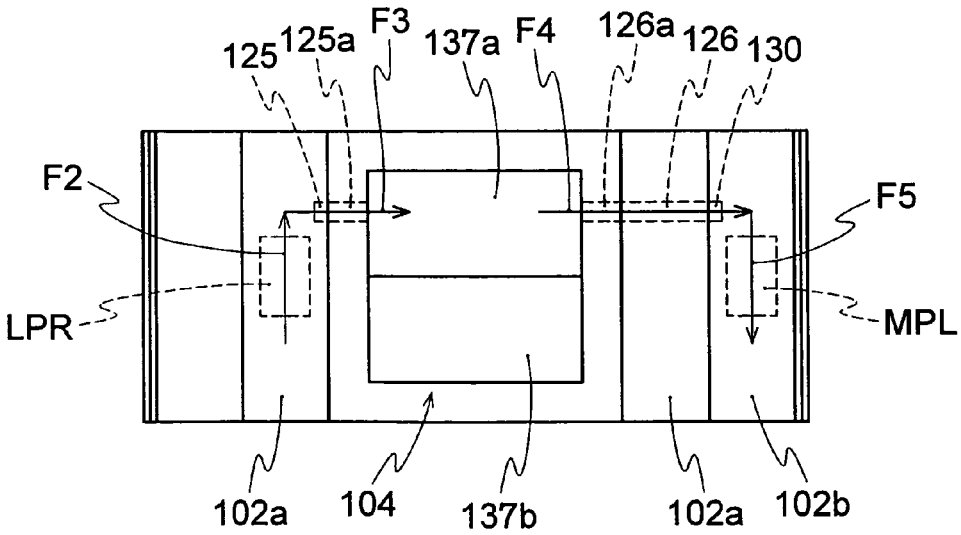

Referring FIGS. 29, 30 and 38, firstly, it is assumed that air is sucked from the suction portions 135*a* of the lid 107 to the suction tank portion 133*a* of the first tank portion for vent 103. After the air sucked passed the passage 124*a* of the frame 94 and the passage 124 of the right pump casing 102*a*, it is sucked in the low-pressure pump chamber LPR (airflow of F1 to F2). Then, after the air pressured in the pump chamber LPR passed the passage 125*a* of the frame 94 and the passage 125 of the right pump casing 102*a*, it flows in the vent chamber 137*a* of the second tank portion for vent 104 (airflow of F3). After the pressured air passed the passage 126*a* of the frame 94, the passage 126 of the left pump casing 102*a* and the passage 130 of the left pump casing 102*b*, it flows in the medium pressure pump chamber MPL (airflow of F4 to F5). Then, after the air pressured in the pump chamber MPL passed the passage 131 of the left pump casing 102*b*, the passage 127 of the left pump casing 102*a* and the passage 127*a* of the frame 94, it flows in the discharge tank portion 134 of the first tank portion for vent 103 (airflow of F6). Then, medium pressure air is discharged from the discharge portion 136.

Namely, in the present Embodiment, the suction tank portion is linked with the right low pressure pump portion (the suction chamber, the pump chamber and the discharge chamber), and linked with the vent chamber. Further, the vent chamber is linked with the passage of the left low pressure pump portion and the passage of the medium pressure pump, and linked with the medium pressure pump portion (the suction chamber, the pump chamber and the discharge chamber). Accordingly, after air compressed in the pump chamber of the medium pressure pump portion flowed in the discharge tank portion from the discharge chamber through the passage of the left low pressure pump, it is discharged from the discharge portion.

Further, airflow sucked in the above-mentioned suction tank portion 133*b* is symmetrical flow as compared from the above-mentioned airflow. As a result, the air circuit in the present Embodiment becomes 2 circuits.

In the present Embodiment, the frame 94, the pump casing at lower pressure side 102*a* and the pump casing at medium pressure side 102*b* are nearly the same outer shape. Since 2 passages which are linked with the pump portion (the suction chamber, the pump chamber and the discharge chamber) of the left and right pump casing portions at medium pressure side are formed in the left and right pump casing portions at low pressure side, the design of passage piping is easy without using piping tubes. Consequently, the preparation cost of the molds of the pump casing at low pressure side and the pump casing at medium pressure side can be reduced, and the management of parts becomes easy.

Further, in the present Embodiment, the pump casing portions at lower pressure side and at medium pressure side 102*a* and 102*b* can be respectively bonded with the frame 94 by 4 penetration bolts 112, and vent piping can be simultaneously carried out, therefore the assembly of pumps is easy. Further, in the present Embodiment, since the suction chamber and the discharge chamber which are formed in the respective pump casings 102*a* and 102*b* are arranged at the side-face side to a lateral direction of the pump chamber (to a vertical direction to the axis of the vibrator 97), namely, at the side-face side of the cone portion 121 and the columnar portion 128, the length of the whole pump can be reduced and small sizing can be designed.

Further, in the present Embodiment, since there is no protruded portion other than the discharge portion for evacuation, it can be easily installed in the instrument to which the pump is applied.

Figure 39:
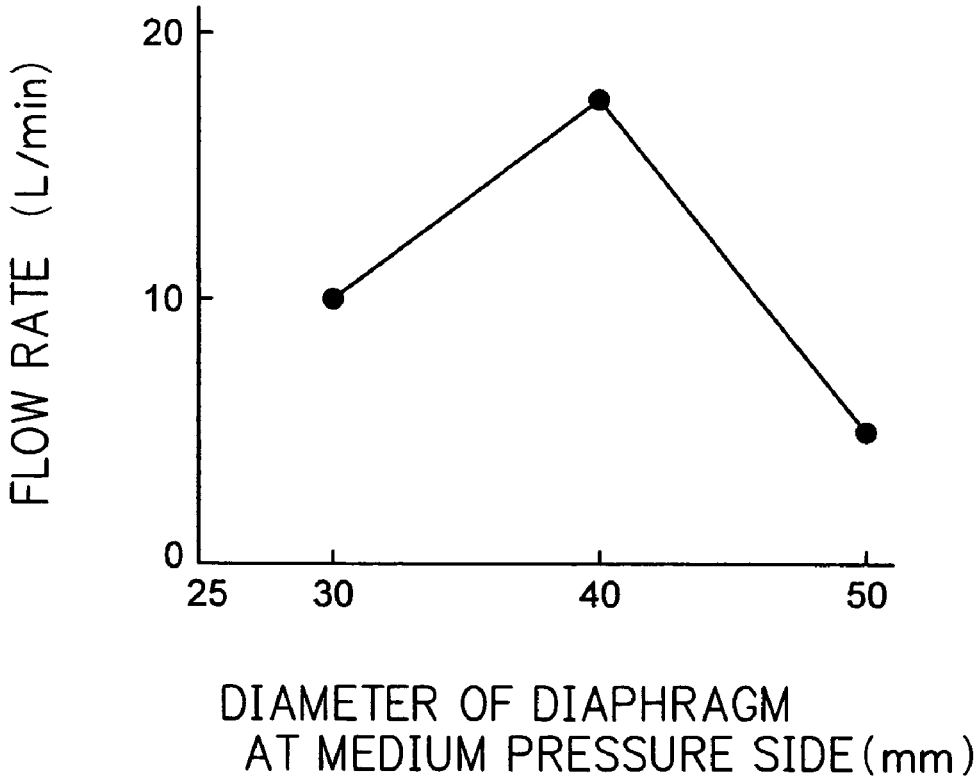
FIG. 39 is a view showing relation between flow rate and the diameter of diaphragm at medium pressure side.

Further, the diameter of the diaphragm of the pump casing at medium pressure side is an important dimension determining property. When the diameter is set to be too large for enlarging flow rate, driving force is lowered because of load pressure (back pressure), and there is a fear that the fixed vibrational amplitude of the vibrator is not obtained. Accordingly, as a result, the raise of flow rate and pressure cannot be attained. Consequently, it is required that the optimum dimension of diaphragm is determined by theory, trial preparation and the like. The measurement value of relation between the flow rate and the diameter of the diaphragm at medium pressure side is shown in FIG. 39. At experiment, the diameter of the diaphragm at low pressure side was 50 mm and vibrational frequency was 60 Hz.

Theoretically, rational compression ratio in multi steps compression is $r=i\sqrt{(pf/p1)}$ when the number of steps is i. For example, since pf/p1=200/100 in case of 2 steps compression, r is $\sqrt{2}$. Hereat, pf is pressure (kPa) at the second step, and p1 is pressure (normal pressure) (kPa) at the first step. Accordingly, the ratio of the diameter of diaphragm at low pressure side to the diameter of diaphragm at medium pressure side is set as $\sqrt{2}$, and the efficiency of pumps can be enhanced. For example, the efficiency of a conventional low pressure pump is about 20 to 30% and low, but the efficiency of the medium pressure pump in the present Embodiment is 40% or more. This is caused by the goodness or badness of design, although there is influence of pressure. Further, the higher the pressure is, the higher the efficiency (the efficiency of an electromagnet is not included) of the pump itself is apt to be, but the medium pressure pump can further improve the efficiency than the low pressure pump because of the improvement by multi steps compression.

Embodiment 9

The medium pressure is designed to be generated using 4 diaphragms in the Embodiments hitherto, but in the present invention, it is not limited to this, and a semi-medium pressure pump which can improve pressure more slightly than low pressure and a medium pressure pump in which air circuit is one circuit can be easily composed by combining the left and right pump casings at low pressure side and at medium pressure side. Further, although it is low pressure, the smaller sized pump than a conventional pump can be also obtained.

Figure 40:
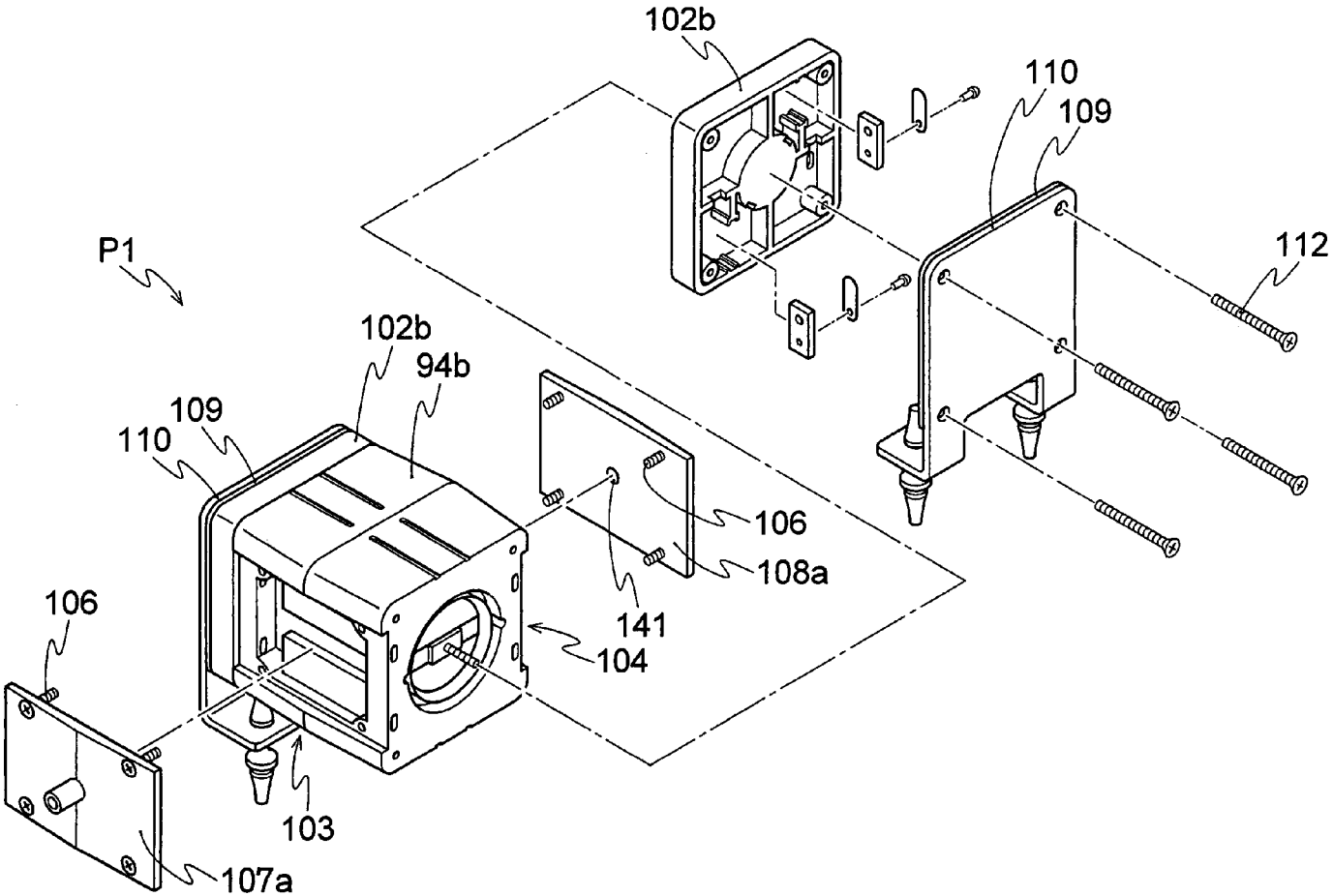
FIG. 40 is a decomposed cross-eyed view showing the electromagnetic vibrational diaphragm pump related to Embodiment 9 of the present invention.

Firstly, as shown in FIG. 40 and Table 1, the pump P1 related to the present Embodiment is equipped with the medium pressure pump casing 102*b* which is installed at the left and right sides of the frame 94*b*, the packing 109 and the side boards 110 which are installed at said left and right pump casings 102*a* and 102*b*, the lids 107*a* and 108*a* which are installed at the first tank portion for vent 103*a* and the second tank portion for vent 104*a* of the above-mentioned frame 94*b*, and the bolts 112 which fix the respective pump casings 102*a* and 102*b*, the packing 109 and the side board 110 at the both ends of the frame 94*b*. The above-mentioned lid 107*a* does not form a suction orifice, different from the lid 107 in the above-mentioned Embodiment 8. Further, the suction orifice 141 is formed at the above-mentioned lid 108*a*. In the present Embodiment, the frame 94*b* in which the partitioning wall was eliminated from the first tank portion for vent 103 and the second tank portion for vent 104 of the frame 94 in the above-mentioned Embodiment 8 is used. For example, the frame 94*b* in which the partitioning wall was eliminated can be prepared only by changing mold parts which mold the partitioning wall. The left and right pump portions of the pump P1 in the present Embodiment are connected in parallel since airflow eliminated the low pressure pump portion in the above-mentioned Embodiment 8 (it is relation that suction is a right side and exhaustion is a left side).

TABLE 1

| Modified spots* | Pump P1 (pump of FIG. 40) | Pump P2 (pump of FIG. 41) | Pump P3 (pump of FIG. 42) |
|---|---|---|---|
| Pump portion | Left and right low pressure pump casings are eliminated. | Left low pressure pump casing and right middle pressure pump casing are eliminated. | Left and right middle pressure pump casings are eliminated. |
| Tank portion, frame and lid | Partitioning wall between the first tank portion for vent and the second tank portion for vent is deleted. Dimension of diaphragm stand of frame is changed. Lids for suction and discharge of both tank portions are changed. | Dimension of diaphragm stand of frame is changed. | Discharge portion is provided on lid of the second tank portion for vent. |
| Diaphragm | Diaphragm is changed to disc type. Retaining metal fittings for binding diaphragm of vibrator is changed. | Retaining metal fittings for binding diaphragm of vibrator is changed. Diaphragm of middle pressure pump casing is changed to disc type. | Retaining metal fittings for binding diaphragm of vibrator is changed. |

Modified spots * in Table 1 are the modified spots shown in FIGS. 28 to 39.

Figure 41:
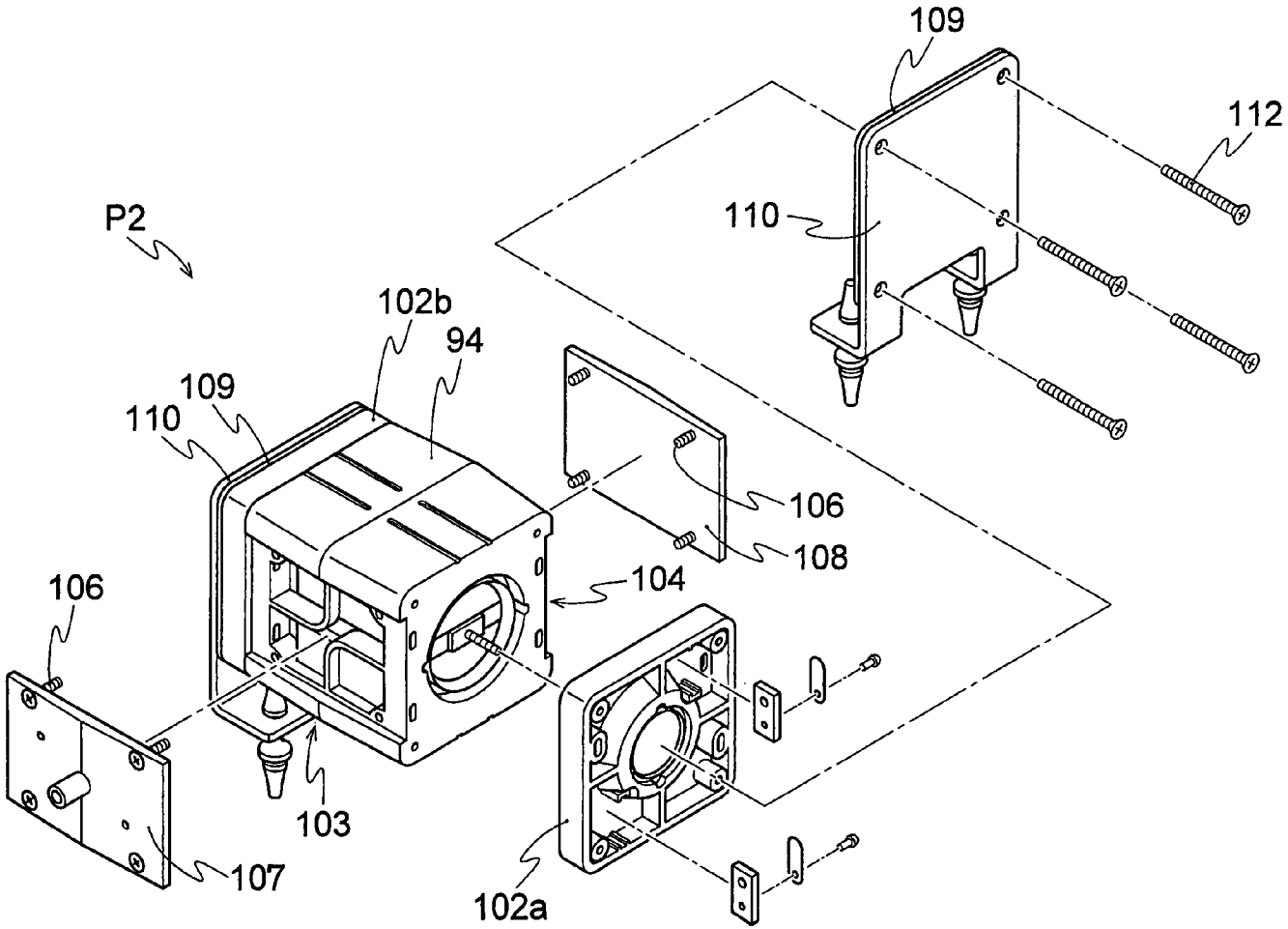
FIG. 41 is a decomposed cross-eyed view showing other pump related to Embodiment 9.

Then, as shown in FIG. 41 and Table 1, the other pump P2 related to Embodiment 9 is equipped with the medium pressure pump casing 102*b* which is installed at the left side of the frame 94, the low pressure pump casing 102*a* which is installed at the right side of the frame 94, the packing 109 and the side boards 110 which are installed at left and right pump casings 102*a* and 102*b*, the lids 107 and 108 which are installed at the first tank portion for vent 103 and the second tank portion for vent 104 of the frame 94, and the bolts 112 which fix the respective pump casings 102*a* and 102*b*, the packing 109 and the side boards 110 at the both ends of the frame 94.

The pump P2 can generate medium pressure, and air circuit is one circuit nevertheless the air circuit of the pump related to the above-mentioned Embodiment 8. Since the structure is simple, production cost can be reduced. However, flow rate is one half of the pump related to the above-mentioned Embodiment 8.

Further, the structures of the above-mentioned pumps P1 and P2 require the change of diaphragm stand, namely, the change of mold parts, but the diaphragm stand is prepared as separate parts, and a composition in which it is not annexed to the frame can be also set. The method is effective for exchange of a mold when production number is little.

The airflow of the left and right pump portions of the pump P2 in the present Embodiment becomes the airflow in case of eliminating the right medium pressure pump portion and the left low pressure pump portion in the above-mentioned Embodiment 8, and is basically similar as the medium pressure pump of the above-mentioned Embodiment 8. Further, the above-mentioned left and right pump portions are connected in series.

Figure 42:
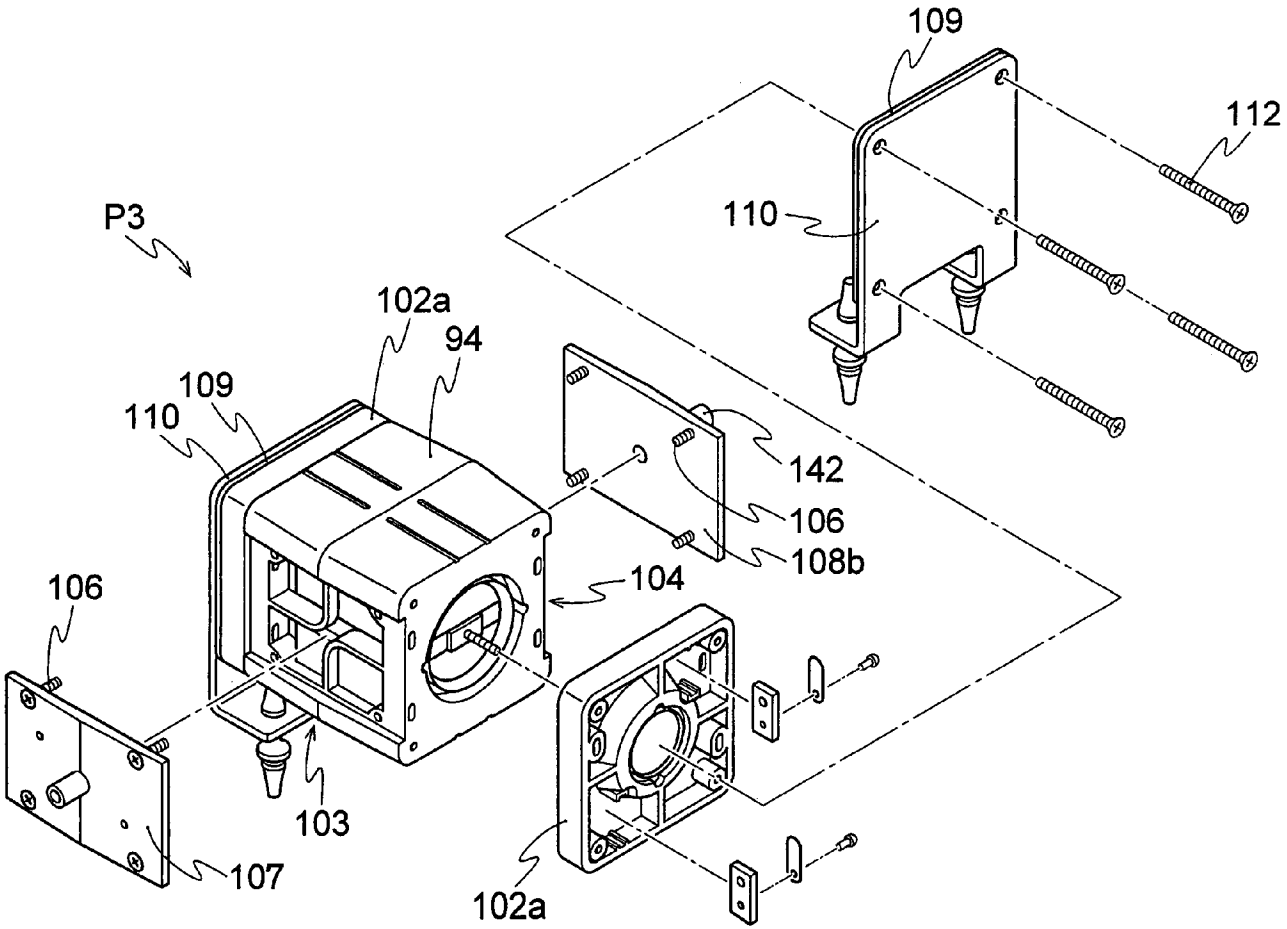
FIG. 42 is a decomposed cross-eyed view further showing other pump related to Embodiment 9.

Then, as shown in FIG. 42 and Table 1, the other pump P3 related to Embodiment 9 is equipped with the low pressure pump casing 102*a* which is installed at the left and right side of the frame 94*b*, the packing 109 and the side boards 110 which are installed at said left and right pump casings 102*a*, the lids 107 and 108*a* which are installed at the first tank portion for vent 103 and the second tank portion for vent 104 of the above-mentioned frame 94, and the bolts 112 which fix the respective pump casings 102*a*, the packing 109 and the side boards 110 at the both ends of the frame 94*b*. The above-mentioned lid 108*b* forms the discharge portion 142, different from the lid 108 in the above-mentioned Embodiment 8. Further, in the present Embodiment, the frame 94 in the above-mentioned Embodiment 8 is used, but a frame in which the partitioning wall was eliminated from the first tank portion for vent 103 and the second tank portion for vent 104 can be also used.

The airflow of the left and right pump portions of the pump P3 in the present Embodiment becomes the airflow in case of eliminating the left and right medium pressure pump portions in the above-mentioned Embodiment 8, and is a passage from the suction tank portions 133*a* and 133*b* to the vent chamber and the discharge portion 142 through the low pressure pump portion. The respective pump portions are connected in parallel.

Figure 44:
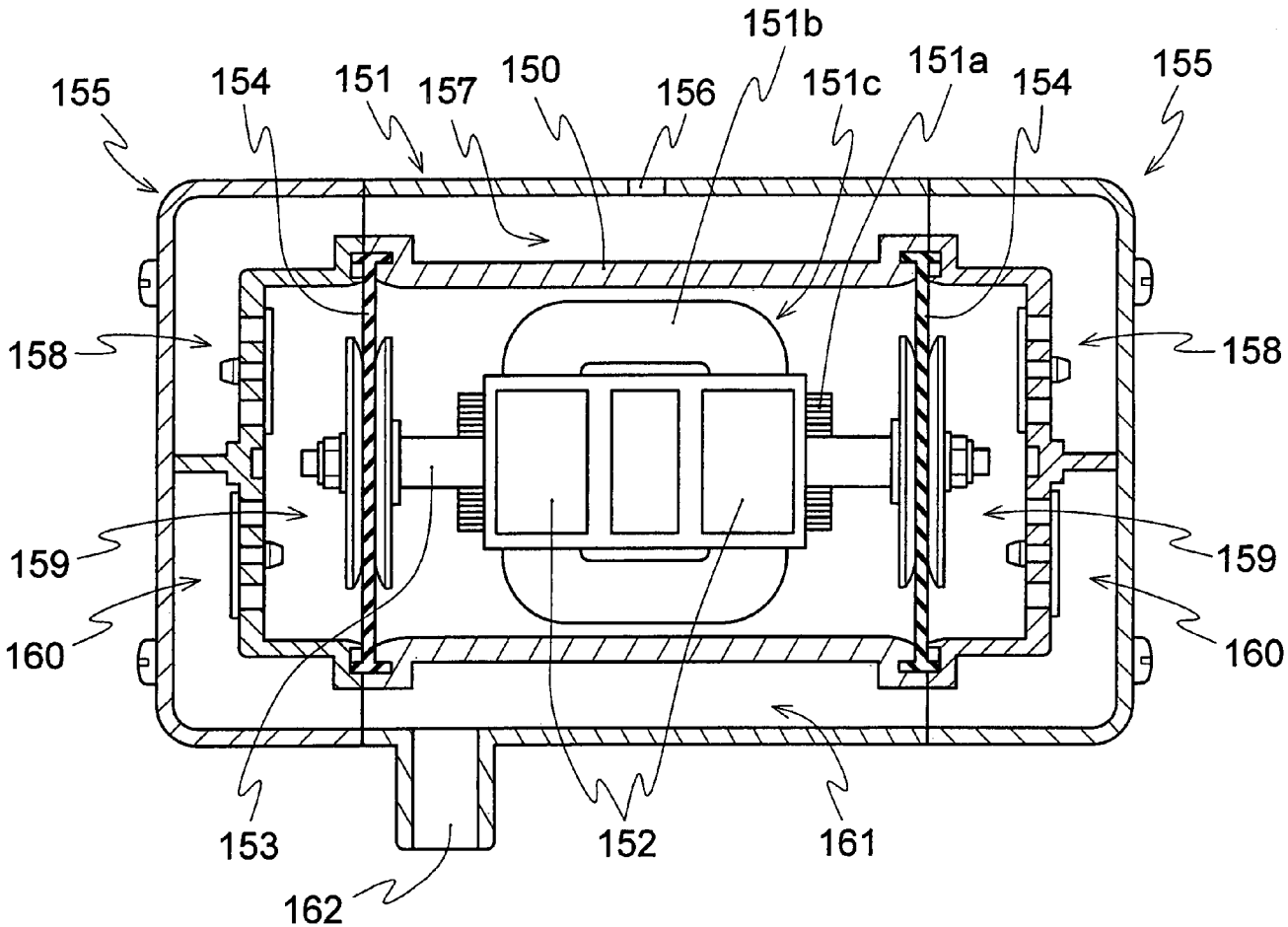
FIG. 44 is a longitudinal sectional view showing one example of conventional electromagnetic vibrational diaphragm pumps.

Hereat, as shown in FIG. 44, since the pump chamber 159 is formed from the bottom portion of the pump casing portion 155 to the diaphragm 154 side and the suction chamber 158 and the discharge chamber 160 are designed to be formed from said bottom portion to the pump casing portion 155 in the structure of a conventional diaphragm pump, it is difficult to obtain the small sizing of pump outer shape to a longitudinal direction of the vibrator 153.

To the contrary, since the suction chamber and the discharge chamber of the respective pump casings 102*a* are arranged at the side-face side to a lateral direction of the pump chamber in the pump P3 in the present Embodiment, the length of the whole pump can be reduced to design small sizing.

Further, in the respective pumps P1, P2 and P3 related to Embodiment 9, the direction of the suction portion and the discharge portion can be changed to up and down and left and right according to the change of direction of the side board with legs.

Figure 43:
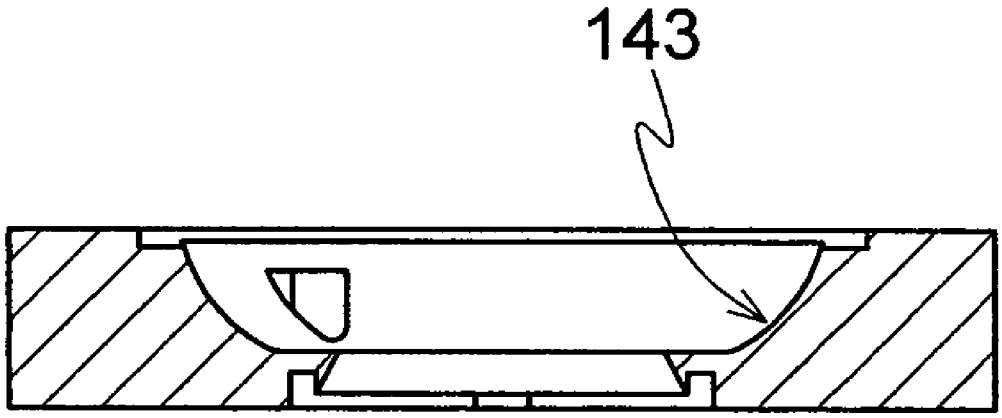
FIG. 43 is a sectional view showing the pump other than the pumps related to Embodiments 8 and 9.

Further, in Embodiments 8 and 9, the bottom shape of the pump chamber of the low pressure pump casing is a cone shape and the bottom shape of the pump chamber of the medium pressure pump casing is a columnar shape, but is not limited to this. The volume of the pump chamber is reduced more than the columnar shape, and pump pressure can be improved by changing the bottom shape of the pump chamber of both pump casings as the cone shape, or the semispherical shape 143 as shown in FIG. 43. Further, the frames in Embodiments 8 and 9 are a resin molded article, but they are not limited to this, and can be prepared with a non magnetic metal such as aluminum. In this case, space between the above-mentioned left and right pump chambers is designed to be connected with vent tubes.

The effects in Embodiments 8 and 9 are as below.

1) Appropriate pump property is obtained by changing the dimension of the diaphragm at medium pressure side.
2) Since the coupling assembly of the low pressure pump casing and the medium pressure pump casing is easy and vent piping (connection) between pumps can be carried out at the same time with assembly, assembly cost can be reduced.
3) The medium pressure pump with good efficiency can be obtained.
4) Since the suction chamber and the discharge chamber of the low pressure pump casing and the medium pressure pump casing are situated at the side-face side of the pump chamber, the whole length of the pump can be shortened.
5) Since the protruding portion from the main body of the pump is only the suction portion and the discharge portion, extra space is unnecessary and installation in the instrument in which the pump is applied is easy.
6) Since a simple pump for low pressure to medium pressure can be composed by carrying out the combination of the low pressure and medium pressure pump portions and slight change in Embodiment 9, various kinds of pumps can be produced with less molds and the initial investment of production can be reduced.
7) Since the direction of the suction portion and the discharge portion can be changed to up and down and left and right by changing the direction of the side board with legs, it is convenient for an instrument to which the pump is applied.

As described above, according to the present invention, medium pressure (about 50 to 200 kPa) can be generated and pump efficiency can be improved.

Further, since there is no friction in comparison with a piston type pump, efficiency is good and the pump is long life. Since the stroke of a diaphragm is shorter than that of a piston, the volume of an electromagnet is small and the pump becomes smaller than the piston type pump.

Further, even a pump having about equal pressure (low pressure) can be small-sized.

INDUSTRIAL APPLICABILITY

An electromagnetic vibrational diaphragm pump that can generate medium pressure (about 50 to 200 kPa) and can be small-sized can be provided.

The invention claimed is:

1. An electromagnetic vibrational diaphragm pump comprising:

an electromagnet portion having an electromagnet arranged in a frame, the electromagnet portion having left and right end portions;

a vibrator supported in said electromagnet portion and equipped with magnets, the vibrator having left and right ends;

left and right diaphragms with a large diameter and left and right diaphragms with a small diameter successively connected with respective ones of both the left and right ends of said vibrator;

left and right pump casing portions of said diaphragms with a large diameter and diaphragms with a small diameter fixed on respective ones of the left and right end portions of said electromagnet portion, said left and right pump casing portions including left and right pump chambers respectively corresponding to the diaphragms with a large diameter and diaphragms with a small diameter;

wherein by conducting low pressure air generated in the pump chamber of the left diaphragm with a large diameter to the pump chamber of the right diaphragm with a small diameter and conducting low pressure air generated in the pump chamber of the right diaphragm with a large diameter to the pump chamber of the left diaphragm with a small diameter, an air circuit of the pump has two air circuits each with two compression steps in series for compressing so that medium pressure air of about 50 to 200 kPa is generated by pumping action.

2. An electromagnetic vibrational diaphragm pump comprising:

an electromagnet portion having an electromagnet arranged in a frame, the electromagnet portion having left and right end portions;

a vibrator supported in said electromagnet portion and equipped with magnets, the vibrator having left and right ends;

left and right diaphragms with a large diameter and left and right diaphragms with a small diameter successively connected with respective ones of both the left and right ends of said vibrator;

left and right pump casing portions of said diaphragms with a large diameter and diaphragms with a small diameter fixed on respective ones of the left and right end portions of said electromagnet portion, said left and right pump casing portions including left and right pump chambers respectively corresponding to the diaphragms with a large diameter and diaphragms with a small diameter;

wherein by connecting the pump chambers of the left and right diaphragms with a large diameter and connecting the pump chambers of the left and right diaphragms with a small diameter with all of said pump chambers being connected in series, an air circuit of the pump has four compression steps in series so that medium pressure air of about 50 to 200 kPa is generated by pumping action.

3. The electromagnetic diaphragm pump of claim 1 or 2, wherein said frame is a resin molded article molded on an outer surface of said electromagnet, the resin molded article being formed with a first tank portion for vent and a second tank portion for vent which are connected with the left and right pump chambers and linked with a suction portion and a discharge portion, and the resin molded article having ring shape grooves to which said diaphragms with a large diameter are installed.

4. The electromagnetic vibrational diaphragm pump of claim 1 or 2 further comprising vent pipes connecting said left and right pump chambers with each other.

5. The electromagnetic vibrational diaphragm pump of claim 1 or 2, wherein said frame is a resin molded article molded on an outer surface of said electromagnet, the resin molded article being formed with a first tank portion for vent and a second tank portion for vent which are connected with the left and right pump chambers and linked with a suction portion and a discharge portion, the resin molded article having ring shape grooves to which said diaphragms with a large diameter are installed and wherein a suction chamber and the first tank portion for vent and a discharge chamber and the second tank portion for vent which are connected with the pump chambers of the pump casing portions for said left and right diaphragms with a large diameter are linked with passages which are formed on the frame and the pump casing portions for the diaphragms with a large diameter, and wherein a discharge chamber and the first tank portion for vent and a suction chamber and the second tank portion for vent which are connected with the pump chambers of pump casing portions said left and right diaphragms with a small diameter are linked with passages which are formed on the pump casing portions for the diaphragms with a large diameter and the diaphragms with a small diameter.

6. The electromagnetic vibrational diaphragm pump of claim 3 further comprising said first tank portion for vent being separated by a partition portion.

7. The electromagnetic vibrational diaphragm pump of claim 3, wherein linking holes which are linked with hermetic space which is hermetically sealed by the fore-mentioned electromagnet portion and the diaphragms with a large diameter are formed on the fore-mentioned second tank portion for vent, and pressure which was generated in the fore-mentioned diaphragms with a large diameter is applied as back pressure on said diaphragms with a large diameter.

8. The electromagnetic vibrational diaphragms pump of claim 1 or 2, equipped with at least 2 of the pump portions of the diaphragms with a small diameter in said left and right pump casing portions, and being multi-step compression.

9. The electromagnetic vibrational diaphragm pump of claim 1 or 2, wherein an outer dimension of the pump casing portions for the diaphragms with a large diameter and an outer dimension of the pump casing portions for the diaphragms with a small diameter are substantially the same.

10. The electromagnetic vibrational diaphragm pump of claim 9, wherein suction chambers and discharge chambers which are formed on said pump casing portions for said diaphragms with a large diameter and said pump casing portions for said diaphragms with a small diameter are arranged at a side-face side to a lateral direction of the pump chambers.

11. The electromagnetic vibrational diaphragm pump of claim 9, wherein said frame is a resin molded article molded on an outer surface of said electromagnet, the resin molded article being formed with a first tank portion for vent and a second tank portion for vent which are connected with the left and right pump chambers and linked with a suction portion and a discharge portion, the resin molded article having ring shape grooves to which said diaphragms with a large diameter are installed, and wherein a suction chamber and the first tank portion for vent and a discharge chamber and the second tank portion for vent which are connected with the pump chambers of pump casing portions for said left and right diaphragms with a large diameter are linked with passages which are formed on the frame and the pump casing portions for the diaphragms with a large diameter, and wherein a discharge chamber and the first tank portion for vent and a suction chamber and the second tank portion for vent which are connected with the um chambers of um casing portions for said left and right diaphragms with a small diameter are linked with passages which are formed on the pump casing portions for the diaphragms with a large diameter and the diaphragms with a small diameter.

12. The electromagnetic vibrational diaphragm pump of claim 9, wherein said magnets have a convex shape.

13. The electromagnetic vibrational diaphragm pump of claim 9, wherein the shape of a bottom portion of the pump chambers of the pump casing portions for said diaphragms with a large diameter and the pump casing portions for the diaphragms with a small diameter is a cone shape or a semi-spherical shape.

14. The electromagnetic vibrational diaphragm pump of claim 11, further comprising side plates which are arranged on a side face of said pump casing portions for the diaphragms with a small diameter, said side plates having legs for installation.

15. An electromagnetic vibrational diaphragm pump comprising:

an electromagnet portion having an electromagnet arranged in a frame, the electromagnet portion having left and right end portions;

a vibrator supported in said electromagnet portion and equipped with magnets, the vibrator having left and right ends;

left and right diaphragms with a large diameter and left and right diaphragms with a small diameter successively connected with respective ones of both the left and right ends of said vibrator;

left and right pump casings fixed on respective ones of the left and right end portions of said electromagnet portion, including pump chambers associated with respective ones of the large diameter and small diameter diaphragms and including suction chambers and discharge chambers formed in said pump casings arranged on a side-face side to a lateral direction of the pump chamber;

wherein by conducting low pressure air generated in the pump chamber of the left diaphragm with a large diameter to the pump chamber of the right diaphragm with a small diameter and conducting low pressure air generated in the pump chamber of the right diaphragm with a large diameter to the pump chamber of the left diaphragm with a small diameter, an air circuit of the pump has two air circuits as each with two compression steps in series for compressing air so that medium pressure air of about 50 to 200 kPa is generated by pumping action.

16. An electromagnetic vibrational diaphragm pump comprising:

an electromagnet portion having an electromagnet arranged in a frame, the electromagnet portion having left and right end portions;

a vibrator supported in said electromagnet portion and equipped with magnets, the vibrator having left and right ends;

left and right diaphragms with a large diameter and left and right diaphragms with a small diameter successively connected with respective ones of both the left and right ends of said vibrator;

left and right pump casings fixed on respective ones of the left and right end portions of said electromagnet portion, including suction chambers and discharge chambers formed in said pump casings arranged on a side-face side to a lateral direction of a pump chamber;

wherein by connecting the pump chambers of the left and right diaphragms with a large diameter and connecting the pump chambers of the left and right diaphragms with a small diameter with all of said pump chambers being connected in series, an air circuit of the pump has four compression steps in series so that medium pressure air of about 50 to 200 kPa is generated by pumping action.

17. The electromagnetic vibrational diaphragm pump of claim 15 or 16, including a frame which is a resin molded article molded on the outer surface of said electromagnet, a first tank portion for vent and a second tank portion for vent which are connected with a left and right pump chambers and linked with a suction portion and a discharge portion, and ring shape grooves to which said diaphragms are installed are simultaneously molded, and said suction chamber and said first tank portion for vent and said discharge chamber and said second tank portion for vent which are connected with the pump chambers of said left and right pump casings are linked with passages which are formed by said frame and said pump casings.

18. The electromagnetic vibrational diaphragm pump of claim 15 or 16, wherein said magnets have a convex shape.

19. The electromagnetic vibrational diaphragm pump of claim 15 or 16, wherein the shape of a bottom portion of said pump chambers of said pump casings is a cone shape or a semispherical shape.

20. The electromagnetic vibrational diaphragm pump of claim 18, further comprising side plates which are arranged on a side face of said pump casings, said side plates having legs for installation.

21. The electromagnetic vibrational diaphragm pump of claim 1, 2, 15 or 16, wherein said electromagnet includes iron cores having an inner peripheral concave portion and winding coil portions which are assembled in the inner peripheral concave portion of said iron cores.

22. The electromagnetic vibrational diaphragm pump of claim 1, 2, 15 or 16, wherein said electromagnet includes a pair of iron cores with a small diameter, a pair of iron cores with a large diameter which are arranged at a position orthogonal to said pair of iron cores with a small diameter, and winding coil portions which are assembled in an inner peripheral concave portion of said iron cores with a large diameter.

23. The electromagnetic vibrational diaphragm pump of claim 1, 2, 15 or 16, wherein the number of magnets of said vibrator is 4, the width dimension of 2 magnets at both end portions is about one half of the width dimension of 2 magnets at a central portion, said iron cores are an E shape, and the pole width dimensions of the center pole portion and the 2 side pole portions which face said magnets are nearly the same dimension together.

24. The electromagnetic vibrational diaphragm pump of claim 1, 2, 15 or 16, wherein said diaphragms with a small diameter are a corrugation type diaphragm.

25. An electromagnetic vibrational diaphragm pump comprising:

an electromagnet portion having an electromagnet arranged in a frame, the electromagnet portion having left and right end portions;

a vibrator supported in said electromagnet portion and equipped with magnets, the vibrator having left and right ends;

left and right diaphragms with a large diameter and left and right diaphragms with a small diameter successively connected with respective ones of both the left and right ends of said vibrator;

left and right pump casing portions of said diaphragms with a large diameter and diaphragms with a small diameter fixed on respective ones of the left and right end portions of said electromagnet portion, said left and right pump casing portions including left and right pump chambers respectively corresponding to the diaphragms with a large diameter and diaphragms with a small diameter;

wherein the outer dimension of the pump casing portions for the diaphragms with a large diameter and the outer dimension of the pump casing portions for the diaphragms with a small diameter are substantially the same; and wherein a suction chamber and a chamber which are formed on a pump casing portion for a diaphragm with a large diameter and a pump casing portion for a diaphragm with a small diameter are arranged at a side-face to a lateral direction of the pump chamber.

26. An electromagnetic vibrational diaphragm pump comprising:

an electromagnet portion having an electromagnet arranged in a frame, the electromagnet portion having left and right end portions;

a vibrator supported in said electromagnet portion and equipped with magnets, the vibrator having left and right ends;

left and right diaphragms with a large diameter and left and right diaphragms with a small diameter connected with respective ones of both the left and right ends of said vibrator;

pump casings fixed on both the left and right end portions of said electromagnet portion, including suction chambers and discharge chambers formed in said pump casings adjoining a pump chamber;

wherein by conducting low pressure air generated in the pump chamber of the left diaphragm with a large diameter to the pump chamber of the right diaphragm with a small diameter and conducting low pressure air generated in the pump chamber of the right diaphragm with a large diameter to the pump chamber of the left diaphragm with a small diameter, an air circuit of the pump has two air circuits each with two compression steps in series for compressing air so that medium pressure air of about 50 to 200 kPa is generated by pumping action;

wherein the diaphragms connected with each of the left and right ends of said vibrator are a diaphragm with a large diameter and a diaphragm with a small diameter.

27. An electromagnetic vibrational diaphragm pump comprising:

an electromagnet portion having an electromagnet arranged in a frame, the electromagnet portion having left and right end portions;

a vibrator supported in said electromagnet portion and equipped with magnets, the vibrator having left and right ends;

diaphragms with a large diameter and diaphragms with a small diameter connected with both said ends of said vibrator;

pump casings fixed on the left and right both end portions of said electromagnet portion, including pump chambers associated with respective ones of the large diameter and small diameter diaphragms and including suction chambers and discharge chambers formed in said pump casings adjoining the pump chambers;

wherein by connecting the pump chambers of the left and right diaphragms with a large diameter and connecting the pump chambers of the left and right diaphragms with a small diameter, all in series, air is compressed in four steps of one circuit as an air circuit of the pump so that medium pressure air of about 50 to 200 kPa is generated by pumping action;

wherein the diaphragms which are connected with each of the left and right ends of said vibrator are a diaphragm with a large diameter and a diaphragm with a small diameter.

* * * * *